US009263181B2

(12) United States Patent
Inoue et al.

(10) Patent No.: US 9,263,181 B2
(45) Date of Patent: Feb. 16, 2016

(54) MULTI-PHASE TRANSFORMER AND TRANSFORMATION SYSTEM

(75) Inventors: Kenichi Inoue, Kobe (JP); Takayoshi Miyazaki, Kobe (JP); Kyoji Zaitsu, Kobe (JP); Koji Inoue, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 13/809,393

(22) PCT Filed: Jul. 22, 2011

(86) PCT No.: PCT/JP2011/004149

§ 371 (c)(1),
(2), (4) Date: Jan. 9, 2013

(87) PCT Pub. No.: WO2012/014424

PCT Pub. Date: Feb. 2, 2012

(65) Prior Publication Data

US 2013/0113587 A1 May 9, 2013

(30) Foreign Application Priority Data

Jul. 27, 2010 (JP) ..... 2010-168543
Nov. 26, 2010 (JP) ..... 2010-263745

(51) Int. Cl.
*H01F 30/12* (2006.01)
*H01F 21/02* (2006.01)
(Continued)

(52) U.S. Cl.
CPC ..... *H01F 30/12* (2013.01); *H01F 27/2871* (2013.01)

(58) Field of Classification Search
CPC . H01F 27/2871; H01F 27/25; H01F 27/2847; H01F 27/289; H01F 27/32; H01F 27/323; H01F 27/324; H01F 30/12; H01F 3/04; H01F 5/06
USPC ..... 336/5, 12, 61, 145, 170, 147, 179, 184, 336/212, 213, 219, 220–222, 233, 218
See application file for complete search history.

(56) References Cited

U.S. PATENT DOCUMENTS 2,850,707 A * 9/1958 Wroblewski et al. ..... 336/83
3,068,433 A * 12/1962 Wroblewski et al. ..... 336/83
(Continued)

FOREIGN PATENT DOCUMENTS

JP B-42-023046 11/1967
JP B-44-004806 2/1969
(Continued)

OTHER PUBLICATIONS

Office Action, from the Japanese Patent Office, issued in the Corresponding Japanese Patent Application No. 2010-263745, dated Oct. 20, 2011, pp. 1-5.
(Continued)

*Primary Examiner* — Mangtin Lian
(74) *Attorney, Agent, or Firm* — Studebaker & Brackett PC

(57) ABSTRACT

Provided are a multi-phase transformer having an easier-producible structure, and a transformation system wherein a plurality of such transformers are serially connected. Disclosed is a three-phase transformer (Tra) provided with three coils (1*u*, 1*v*, 1*w*) and a pair of magnetic members (21, 22) respectively provided on opposite ends in the axial direction of the coils (1*u*, 1*v*, 1*w*), wherein the coils (1*u*, 1*v*, 1*w*) are respectively provided with first and second sub-coils (11*u*, 12*u*; 11*v*, 12*v*; 11*w*, 12*w*).

17 Claims, 14 Drawing Sheets

(51) Int. Cl.

| | |
|---|---|
| ***H01F 27/28*** | (2006.01) |
| ***H01F 27/24*** | (2006.01) |
| ***H01F 27/08*** | (2006.01) |

(56) References Cited

U.S. PATENT DOCUMENTS

| | | | | |
|---|---|---|---|---|
| 4,725,804 | A * | 2/1988 | Yarpezeshkan | 336/5 |
| 5,315,982 | A * | 5/1994 | Ward et al. | 123/634 |
| 6,888,436 | B1 * | 5/2005 | Yagasaki | 336/84 C |
| 8,227,763 | B2 * | 7/2012 | Richards et al. | 250/423 R |
| 2003/0112111 | A1 * | 6/2003 | Bolotinsky et al. | 336/170 |
| 2005/0212634 | A1 * | 9/2005 | Baldwin et al. | 336/5 |
| 2010/0259353 | A1 * | 10/2010 | Saito et al. | 336/205 |
| 2013/0113587 | A1 | 5/2013 | Inoue et al. | |

FOREIGN PATENT DOCUMENTS

| | | | |
|---|---|---|---|
| JP | 47-030087 | | 9/1972 |
| JP | 48-061921 | | 8/1973 |
| JP | U-48-062519 | | 8/1973 |
| JP | 48-029930 | | 9/1973 |
| JP | B-51-005180 | | 2/1976 |
| JP | U-54-122316 | | 8/1979 |
| JP | Y-55-008896 | | 2/1980 |
| JP | 58-128713 | A | 8/1983 |
| JP | 59-168618 | A | 9/1984 |
| JP | 59-218714 | | 12/1984 |
| JP | 61-36912 | A | 2/1986 |
| JP | 61-36914 | A | 2/1986 |
| JP | 01-106413 | | 4/1989 |
| JP | 03-280409 | | 12/1991 |
| JP | 04-056303 | | 2/1992 |
| JP | 04-293211 | | 10/1992 |
| JP | 04-350908 | | 12/1992 |
| JP | 06-132109 | | 5/1994 |
| JP | 09-180924 | | 7/1997 |
| JP | 9-275020 | A | 10/1997 |
| JP | 2005-150507 | A | 6/2005 |
| JP | 2011-142149 | A | 7/2011 |

OTHER PUBLICATIONS

International Search Report from the International Bureau in corresponding International Application No. PCT/JP2011/004149, mailed Nov. 1, 2011, pp. 1-2.

Office Action from Japanese Patent Office for corresponding Japanese Patent No. JP 2011-283617 mailed Apr. 23, 2013 in Japanese and English.

Office Action from Japanese Patent Office for corresponding Japanese Patent No. JP 2011-283617 mailed Jul. 30, 2013, in Japanese and English.

* cited by examiner (A) REFORMING (PLASTIC FORMING)

(B) DP WINDING AROUND CENTRAL BOBBIN (NONMAGNETIC)

(C)

MULTI-PHASE TRANSFORMER AND TRANSFORMATION SYSTEM

TECHNICAL FIELD

The present invention relates to a multi-phase transformer used for electric power in plural phases. Furthermore, the present invention relates to a transformation system including a plurality of such transformers connected in series.

BACKGROUND ART

A transformer is also called a voltage converter or an Xformer, and it serves as a component for transferring electric energy flowing in a primary coil to a secondary coil through electromagnetic induction. The transformer is widely used in not only electric products and electronic products, but also in electric power systems, etc. Such a transformer generally includes a primary coil, a secondary coil, and a core. The primary coil and the secondary coil are each constituted by winding, e.g., a soft copper wire, which has an insulating coating and has a round or rectangular sectional shape, around the core. The core is constituted, for example, by stacking a plurality of thin electrical steel sheets, e.g., silicon steel sheets. The core functions as a magnetic circuit for coupling the primary coil and the secondary coil to each other with mutual inductance. As other related-art transformers, there are, e.g., a transformer including a plurality of secondary coils to be adapted for plural transformation ratios, and a transformer including a tertiary coil for a specific purpose.

One of those transformers is disclosed in, e.g., Patent Literature (PTL) 1. In the transformer disclosed in PTL 1, a strip-like electrical steel sheet is wound and the wound electrical steel sheet is cut in a widthwise direction. After inserting two windings through the cut, cut ends of the wound electrical steel sheet at the cut are abutted and joined to each other, thus closing the cut, while the windings are fixedly held. In the transformer disclosed in PTL 1, the wound electrical steel sheet corresponds to the core, and the windings correspond to the coils.

In the related-art transformers described above, the core is of an annular structure having a circular or square shape, for example, to form a magnetic circuit, which can eliminate a leakage of magnetic flux to the exterior, and which can realize efficient magnetic coupling from the primary coil to the secondary coil. Therefore, when the primary coil and the secondary coil are each fabricated by winding a wire around the core that remains in the annular structure, an operation of winding the wire is complicated because the core has the annular structure, thus causing a limit in increasing productivity. On the other hand, from the viewpoint of facilitating the winding operation, when the winding operation is separately performed on each of plural separated members of the core and the plural members are then joined to each other to form the core of the annular structure, or when the wound electrical steel sheet (core) is cut in the widthwise direction and, after inserting the windings through the cut, the cut ends are jointed to each other to close the cut as described in PTL 1, the joining operation requires to be performed in a manner minimizing the magnetic kiss. In PTL 1, particularly, because the cut ends have to be processed so as to incline at an angle of 50° to 70° with respect to the winding direction, substantial time and labor are needed.

CITATION LIST

Patent Literature

PTL 1: Japanese Unexamined Patent Application Publication No. 2005-150507

SUMMARY OF INVENTION

The present invention has been accomplished in view of the above-described situation, and its object is to provide a multi-phase transformer having a structure that facilitates manufacturing of the transformer in comparison with the related art, and a transformation system including a plurality of such transformers connected in series.

The multi-phase transformer and the transformation system including the multi-phase transformer, according to the present invention, include a plurality of coils disposed between a pair of magnetic members, and each of the plural coils includes a plurality of sub-coils. In the multi-phase transformer thus constructed, magnetic flux generated by one of the plural coils passes through the magnetic member disposed at one end of the one coil, through the other coil(s), and through the magnetic member disposed at the other end of the one coil for return to the one coil. In the multi-phase transformer thus constructed, therefore, lines of magnetic fluxes generated by the plural coils are canceled at upper and lower ends of the coils, and cores to be arranged to surround respective lateral surfaces of the coils are no longer required. As a result, the multi-phase transformer and the transformation system, each having the above-described construction, can more easily be manufactured than those of the related art.

The above-mentioned and other objects, features, and advantages of the present invention will be apparent from the following detailed description and the attached drawings.

DESCRIPTION OF EMBODIMENTS

Figure 1:
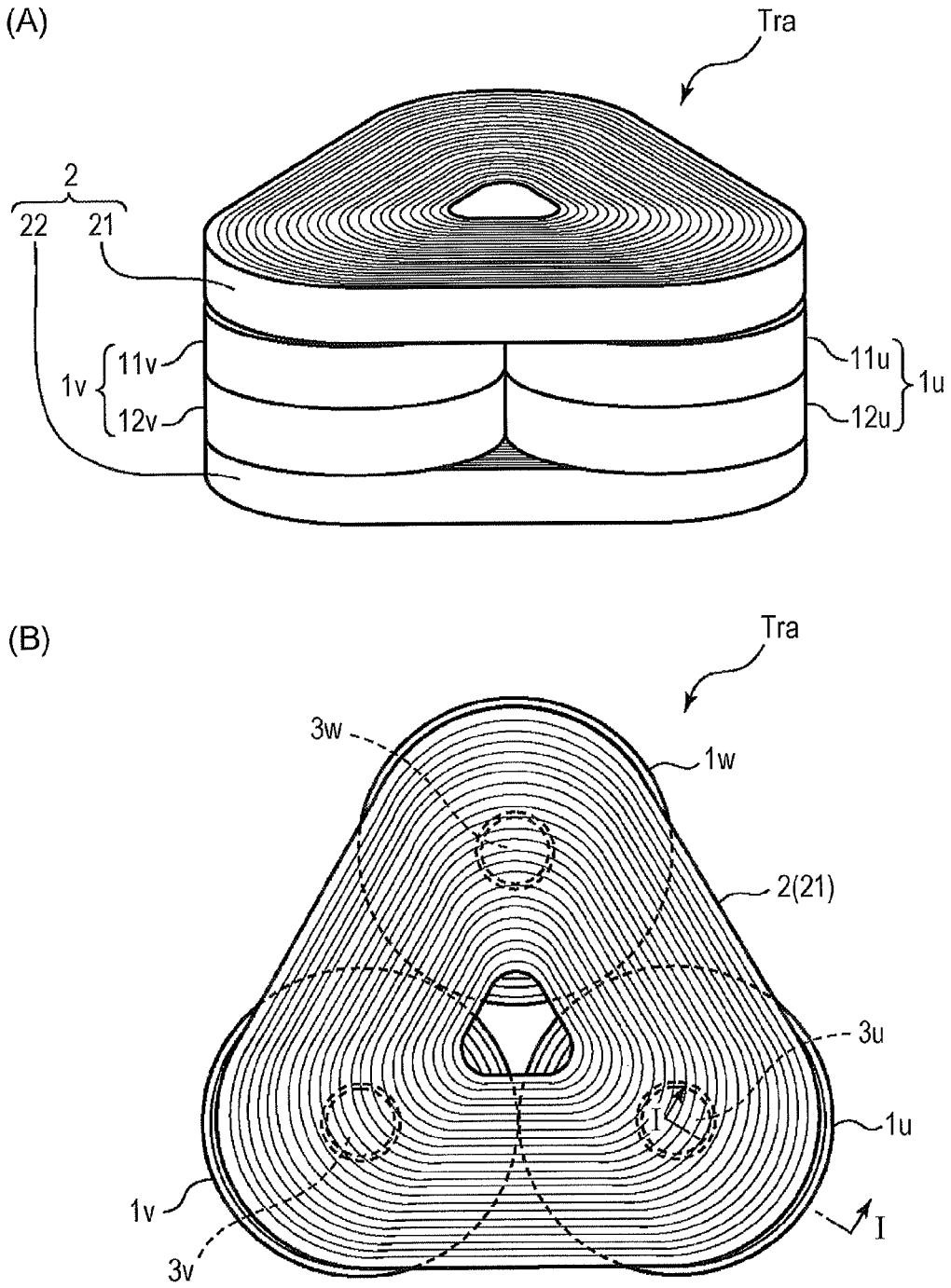
FIG. 1 illustrates the construction of a 3-phase transformer according to a first embodiment.

Embodiments of the present invention will be described below with reference to the drawings. It is to be noted that components denoted by the same reference symbols in the drawings are the same components, and duplicate description of those components is omitted as appropriate.

First Embodiment

Figure 2:
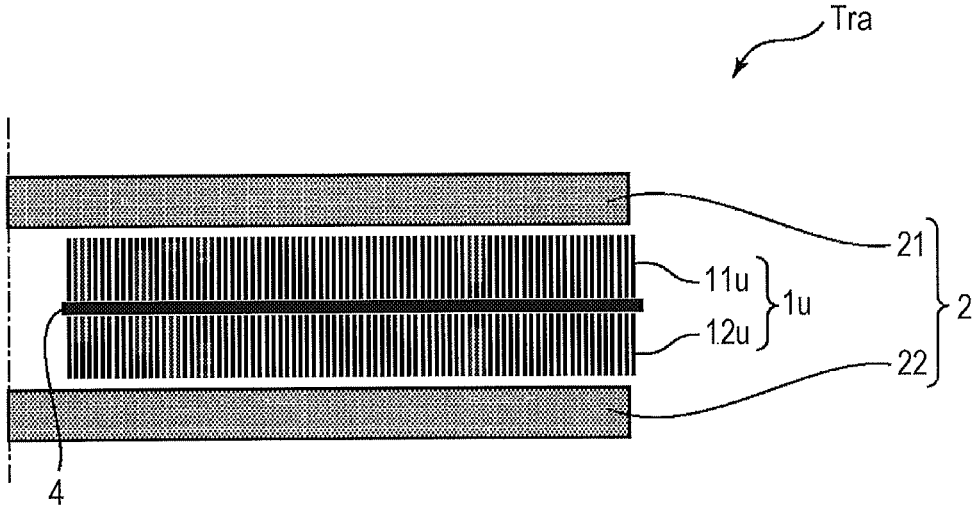
FIG. 2 is a sectional view, taken along a cutting-plane line I-I in FIG. 1(B), of the 3-phase transformer according to the first embodiment.

FIG. 1 illustrates the construction of a 3-phase transformer according to a first embodiment. FIG. 1(A) is a perspective view of the 3-phase transformer, and FIG. 1(B) is a top plan view thereof. FIG. 2 is a sectional view, taken along a cutting-plane line I-I in FIG. 1(B), of the 3-phase transformer according to the first embodiment.

In FIG. 1, a 3-phase transformer Tra of the first embodiment includes a plurality of coils 1, and magnetic members 2 for causing magnetic fluxes generated by the coils 1 to pass therethrough in a substantially concentrated way.

Because the 3-phase transformer Tra of the first embodiment is used for 3-phase AC power having a U-phase, a V-phase, and a W-phase, the plurality of coils 1 are constituted as three coils, i.e., a U-phase coil 1*u* for use in the U-phase, a V-phase coil 1*v* for use in the V-phase, and a W-phase coil 1*w* for use in the W-phase. The U-phase, the V-phase, and the W-phase have respective phases shifted from each other in units of 120 degrees. Assuming the phase of the U-phase to be a reference, for example, the phase of the V-phase is advanced 120 degrees from the phase of the U-phase, and the phase of the W-phase is retarded 120 degrees from the phase of the U-phase.

Each of those three coils 1 (1*u*, 1*v*, 1*w*) includes a plurality of sub-coils. The number of plural sub-coils may be set to an optional value, e.g., a value appropriately designed depending on use of the 3-phase transformer Tra. In an example illustrated in FIGS. 1 and 2, the plural sub-coils are constituted as two first and second sub-coils 11 and 12. More specifically, the U-phase coil 1*u* includes a first U-phase sub-coil 11*u* and a second U-phase sub-coil 12*u*. The V-phase coil 1*v* includes a first V-phase sub-coil 11*v* and a second V-phase sub-coil 12*v*. The W-phase coil 1*w* includes a first W-phase sub-coil 11*w* and a second W-phase sub-coil 12*w*. For example, the first sub-coils 11 (11*u*, 11*v*, 11*w*) serve as primary coils (or secondary coils), and the second sub-coils 12 (12*u*, 12*v*, 12*w*) serve as secondary coils (or primary coils). When the number of plural sub-coils is three or more, the secondary coil may be provided in plural, or a third coil dedicated for a specific purpose (specific use), e.g., a feedback coil, may be provided in addition to the primary and secondary coils.

In this description, when a component is generically indicated, the component is denoted by a reference symbol without a suffix, and when components are individually indicated, the components are each denoted by a reference symbol with a suffix.

The first and second sub-coils 11 and 12 may be each constituted, for example, by winding a conductive wire having, e.g., a circular or square sectional shape and coated with an insulating film. In the first embodiment, however, each sub-coil is constituted by winding a strip-like conductor member such that a widthwise direction of the conductor member is aligned with an axial direction of the relevant coil 1. More specifically, the first and second sub-coils 11 and 12 are each formed by winding a strip-like conductor member, which is coated with an insulating film on one surface thereof, in a predetermined number of times into a spiral shape, i.e., into the form of the so-called single-pancake winding. Alternately, the first and second sub-coils 11 and 12 are each formed by winding the strip-like conductor member, with a comparatively thin insulating sheet interposed between turns of the conductor member, in a predetermined number of times into a spiral shape, i.e., into the form of the so-called single-pancake winding. Such a strip-like long conductor member has the shape of a sheet, a ribbon, or a tape, and a ratio of its thickness (length in the thickness direction) t to its width (length in the widthwise direction) W is less than 10 ($0<t/w<10$).

Furthermore, as illustrated in FIGS. 1 and 2, the first and second sub-coils 11 and 12 are stacked in such a state that an insulating material 4 is interposed therebetween in the axial direction of the relevant coil 1.

The magnetic members 2 include a pair of members 21 and 22 disposed at respective axial opposite ends of the plural coils 1 in covering relation. Thus, the magnetic members 2 are constituted as a pair of members 21 and 22 disposed at respective axial opposite ends of the plural coils 1 so as to cover just those opposite ends. In other words, the 3-phase transformer Tra of the first embodiment has a structure of sandwiching the plural coils 1 in the axial directions thereof between the pair of magnetic members 21 and 22. The magnetic members 2 (21, 22) each has a predetermined magnetic characteristic (magnetic permeability) depending on, e.g., specifications, etc. The magnetic members are constituted by winding strip-like soft magnetic members such that widthwise directions of the soft magnetic members are aligned with the axial directions of the plural coils 1. More specifically, the pair of magnetic members 21 and 22 are each formed by winding a strip-like (tape- or ribbon-like) soft magnetic member, which is coated with an insulating film on one surface thereof, into a spiral shape, i.e., into the form of the so-called single-pancake winding. Alternately, the pair of magnetic members 21 and 22 are each formed by winding the soft magnetic member, with a comparatively thin insulating sheet interposed between turns of the soft magnetic member, into a spiral shape, i.e., into the form of the so-called single-pancake winding. Such a strip-like soft magnetic member is obtained, for example, by rolling a pure-iron or low-silicon soft magnetic substance into the shape of a strip, and then annealing the rolled strip to provide soft magnetic properties. The insulating coating film and the insulating sheet are made of resin, e.g., a polyimide resin.

In the 3-phase transformer Tra of the first embodiment, the U-phase coil 1*u* having a cylindrical contour and including the first and second U-phase sub-coils 11*u* and 12*u* stacked in the axial direction, the V-phase coil 1*v* having a cylindrical contour and including the first and second V-phase sub-coils 11*v* and 12*v* stacked in the axial direction, and the W-phase coil 1*w* having a cylindrical contour and including the first and second W-phase sub-coils 11*w* and 12*w* stacked in the axial direction are arranged, such that center points (axial centers) of the coils are matched with apexes of a regular triangle, respectively, and that the coils are positioned side by side with their axial direction being parallel to each other and their one ends on each side being present on the same plane. In core portions of the U-, V-, and W-phase coils 1*u*, 1*v* and 1*w*, pole pieces 3*u*, 3*v* and 3*w* having predetermined magnetic characteristics and having a solid cylindrical shape are arranged in a state penetrating through the first and second sub-coils 11$u$, 12$u$; 11$v$, 12$v$; and 11$w$, 12$w$, respectively. The pole pieces 3$u$, 3$v$ and 3$w$ are each preferably formed of a material having a low hysteresis loss even when magnetic saturation occurs. Such pole pieces 3$u$, 3$v$ and 3$w$ are formed by solidifying alloy powder, which has a comparatively low hysteresis loss, with a thermoplastic resin. One magnetic member 21 is formed by winding the strip-like soft magnetic member to have a cross-section in the form of a substantially chamfered regular triangle, and it is disposed at respective one surfaces of the three U-, V-, and W-phase coils 1$u$, 1$v$ and 1$w$, i.e., at respective one axial ends of the three U-, V-, and W-phase coils 1$u$, 1$v$ and 1$w$ arranged side by side as described above, so as to substantially cover those one surfaces at the one axial coil ends. Similarly, the other magnetic member 22 is formed by winding the strip-like soft magnetic member to have a cross-section in the form of a substantially chamfered regular triangle and is disposed at respective one surfaces of the three U-, V-, and W-phase coils 1$u$, 1$v$ and 1$w$, i.e., at respective the other axial ends of the three U-, V-, and W-phase coils 1$u$, 1$v$ and 1$w$ arranged side by side as described above, so as to substantially cover those other surfaces at the other axial coil ends.

The 3-phase transformer Tra thus constructed has a structure of sandwiching the plural coils 1 between the pair of magnetic members 2. In the U-phase, therefore, when AC power is supplied to the primary coil (e.g., the first sub-coil 11$u$) of the U-phase coil 1$u$, a magnetic field is formed by the relevant primary coil, and magnetic flux of the magnetic field generated by the relevant primary coil extends from the relevant primary coil to pass through the one magnetic member 21, through the other V-phase coil 1$v$ and the W-phase coil 1$w$, and further through the other magnetic member 22 for return to the relevant primary coil. Accordingly, the secondary coil (e.g., the second sub-coil 12$u$) of the U-phase coil 1$u$ is magnetically coupled to the relevant primary coil through the magnetic members 2, whereby the AC power supplied to the relevant primary coil is transmitted to the relevant secondary coil with electromagnetic induction and a predetermined voltage is induced therein. Similarly, in the V-phase, when AC power is supplied to the primary coil (e.g., the first sub-coil 11$v$) of the V-phase coil 1$v$, a magnetic field is formed by the relevant primary coil, and magnetic flux of the magnetic field generated by the relevant primary coil extends from the relevant primary coil to pass through the one magnetic member 21, through the other W-phase coil 1$w$ and the U-phase coil 1$u$, and further through the other magnetic member 22 for return to the relevant primary coil. Accordingly, the secondary coil (e.g., the second sub-coil 12$v$) of the V-phase coil 1$v$ is magnetically coupled to the relevant primary coil through the magnetic members 2, whereby the AC power supplied to the relevant primary coil is transmitted to the relevant secondary coil with electromagnetic induction and a predetermined voltage is induced therein. Similarly, in the W-phase, when AC power is supplied to the primary coil (e.g., the first sub-coil 11$w$) of the W-phase coil 1$w$, a magnetic field is formed by the relevant primary coil, and magnetic flux of the magnetic field generated by the relevant primary coil extends from the relevant primary coil to pass through the one magnetic member 21, through the other U-phase coil 1$u$ and the V-phase coil 1$v$, and further through the other magnetic member 22 for return to the relevant primary coil. Accordingly, the secondary coil (e.g., the second sub-coil 12$w$) of the W-phase coil 1$w$ is magnetically coupled to the relevant primary coil through the magnetic members 2, whereby the AC power supplied to the relevant primary coil is transmitted to the relevant secondary coil with electromagnetic induction and a predetermined voltage is induced therein. The pair of magnetic members 21 and 22 functions as a part of a magnetic circuit for returning the magnetic fluxes generated by the coils 1 and coupling the primary coil and the secondary coil to each other with mutual inductance.

Thus, lines of the magnetic fluxes generated by the coils 1$u$, 1$v$ and 1$w$ are canceled at upper and lower ends of the coils. Hence, the multi-phase transformer Tra having the above-described construction does not need cores that are arranged to surround respective lateral surfaces of the coils 1$u$, 1$v$ and 1$w$, and it is no longer required to form the sub-coils 11$u$, 12$u$; 11$v$, 12$v$; and 11$w$, 12$w$, which function as the primary coil, the secondary coil, etc., by winding the wires around the annular core unlike the related art described in the background art. As a result, the multi-phase transformer Tra having the above-described construction can more easily be manufactured than the transformer of the related art.

Furthermore, because of the structure in which the magnetic members 2 sandwich the coils 1$u$, 1$v$ and 1$w$ in the respective phases between two planes having normal directions aligned with the axial directions of the coils 1$u$, 1$v$ and 1$w$ in the respective phases. In addition, the first and second sub-coils 11 and 12 are each constituted by winding the strip-like conductor member such that the widthwise direction of the conductor member is aligned with the axial direction of the relevant coil 1. In a space between the pair of magnetic members 21 and 22, therefore, the conductor members of the first and second sub-coils 11 and 12 are each positioned substantially along the lines of the magnetic fluxes. Accordingly, eddy current losses in the conductor members of the first and second sub-coils 11 and 12 are reduced.

The 3-phase transformer Tra described above can be manufactured, for example, through the following steps.

To form the coils 1$u$, 1$v$ and 1$w$, strip-like conductor members, each of which has a predetermined thickness and which is coated with an insulating film on at least one surface thereof, are prepared in number corresponding to the number of the sub-coils, e.g., six in the example illustrated in FIGS. 1 and 2. Those six conductor members coated with the insulating films are each wound in a predetermined number of times, starting at a position away from the center (axial center) by a predetermined distance. Two of those six conductor members are stacked in pair in the axial direction with the insulating material 4 interposed therebetween. The pole pieces 3$u$, 3$v$ and 3$w$ are inserted through and arranged in respective axial core portions of the three pairs of conductor members. Alternatively, every twos of those six conductor members coated with the insulating films are wound respectively around the pole pieces 3$u$, 3$v$ and 3$w$, including the insulating materials 4 on their outer peripheries, in a predetermined number of times. As a result, the coils 1$u$, 1$v$ and 1$w$, each having a cylindrical contour, are formed in a state where the first and second sub-coils 11$u$, 12$u$; 11$v$, 12$v$; and 11$w$, 12$w$ are stacked in the axial direction, respectively.

On the other hand, to form the pair of magnetic members 21 and 22, two strip-like soft magnetic members, each of which has a predetermined thickness and which is coated with an insulating film on at least one surface thereof, are prepared. Those two soft magnetic members coated with the insulating films are each wound in a predetermined number of times, starting at a position away from the center (axial center) by a predetermined distance, so as to have a cross-section in the form of a substantially chamfered regular triangle. As a result, the pair of magnetic members 21 and 22 are formed.

Then, the U-phase coil 1$u$, the V-phase coil 1$v$, and the W-phase coil 1$w$ are arranged side by side such that the center points (axial centers) of the coils are matched respectively with apexes of a triangle, and that the axial directions of the coils are parallel to each other.

Then, the one magnetic member 21 is fixedly bonded to respective one axial ends of the U-phase coil 1*u*, the V-phase coil 1*v*, and the W-phase coil 1*w*, which are arranged side by side, using a high-molecular adhesive, e.g., an epoxy-based adhesive. Similarly, the other magnetic member 22 is fixedly bonded to respective other axial ends of the U-phase coil 1*u*, the V-phase coil 1*v*, and the W-phase coil 1*w*, which are arranged side by side. Thus, the 3-phase transformer Tra is manufactured.

As described above, since the 3-phase transformer Tra of the first embodiment has the structure that the three coils 1*u*, 1*v* and 1*w* in the U-phase, the V-phase, and the W-phase are sandwiched between the pair of magnetic members 21 and 22, the lines of the magnetic fluxes generated by the coils 1*u*, 1*v* and 1*w* are canceled at upper and lower ends of the coils. Therefore, the 3-phase transformer Tra does not need cores that are arranged to surround respective lateral surfaces of the coils 1*u*, 1*v* and 1*w*, and it is no longer required to form the sub-coils 11*u*, 12*u*; 11*v*, 12*v*; and 11*w*, 12*w*, which function as the primary coil, the secondary coil, etc., by winding the wires around the annular core unlike the related art described in the background art. As a result, the multi-phase transformer Tra having the above-described construction can more easily be manufactured than the transformer of the related art.

Furthermore, according to the 3-phase transformer Tra of the first embodiment, since the magnetic members 2 (21, 22) can be each formed by winding the strip-like soft magnetic member, the 3-phase transformer Tra of the first embodiment can easily be manufactured. Moreover, as described later, the magnetic member 2 formed by shaping soft magnetic powder with, e.g., pressure shaping, heating, or an adhesive can be fabricated by bulk pressing. While the bulk pressing has a merit in reducing the cost, it needs large-scaled press equipment and is not suitable for the magnetic member 2 having a large size. In contrast, since the magnetic member 2 in the first embodiment is formed by winding the strip-like soft magnetic member as described above, it can easily be manufactured in various sizes ranging from a small diameter, of course, to a large diameter, and cost reduction can be realized.

According to the 3-phase transformer Tra of the first embodiment, since turns of the wound soft magnetic members are insulated from each other by the insulating material, electrical resistance in the radial direction is increased, whereby an eddy current in the magnetic member 2 can effectively be suppressed. To reduce an eddy current loss, the thickness of the soft magnetic member may be set to be not larger than the so-called skin depth 6.

Figure 3:
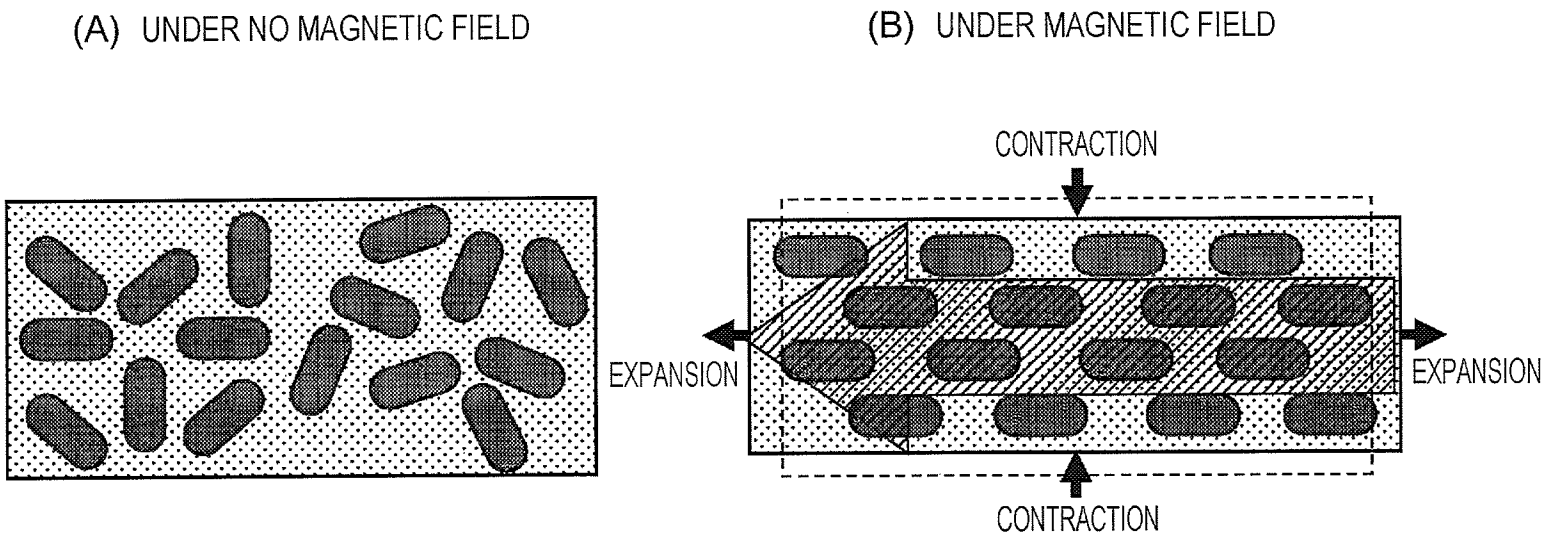
FIG. 3 is an illustration to explain the magnetostrictive effect.

According to the 3-phase transformer Tra of the first embodiment, the magnetostrictive effect generated in the magnetic members 2 (21, 22) can also be suppressed. FIG. 3 is an illustration to explain the magnetostrictive effect. FIG. 3(A) illustrates a state under no magnetic field, i.e., the case where a magnetic field is not applied, and FIG. 3(B) illustrates a state under a magnetic field, i.e., the case where a magnetic field is applied. In more detail, in a magnetic material under no magnetic field without application of any magnetic field, as illustrated in FIG. 3(A), directions of N and S poles in micro-magnets attributable to electron spins are in an uneven state (i.e., a random state where those directions are oriented at random). On the other hand, in the magnetic material under a magnetic field with application of the magnetic field, as illustrated in FIG. 3(B), the directions of N and S poles in the micro-magnets are in an even state, thus producing a strain (magnetostriction) that the magnetic material is expanded in one predetermined direction and is contracted in another predetermined direction in its entirety. In the 3-phase transformer Tra of the first embodiment, expansion and contraction occur in the lengthwise direction of the strip-like soft magnetic member due to the magnetostrictive effect. However, since the strip-like soft magnetic member is wound, the expansion and the contraction are absorbed with relaxing and tightening of the winding in the circumferential direction. Accordingly, even when the expansion and the contraction occur as described above, the expansion and the contraction in the radial direction are reduced to the range of $1/\pi$ ($\pi$ is a circular constant) to ⅓. Thus, the magnetostrictive effect is suppressed.

According to the 3-phase transformer Tra of the first embodiment, because of the structure in which the sub-coils 11*u*, 12*u*; 11*v*, 12*v*; and 11*w*, 12*w* are constituted by winding the strip-like long conductor members such that the widthwise directions of the conductor members are aligned with the axial directions of the coils 1*u*, 1*v* and 1*w* made up of the sub-coils 11*u*, 12*u*; 11*v*, 12*v*; and 11*w*, 12*w*, respectively, and in which the magnetic members 2 sandwich the coils 1*u*, 1*v* and 1*w* between two planes having normal directions aligned with the axial directions of the coils 1*u*, 1*v* and 1*w*, the conductor members of the sub-coils 11*u*, 12*u*; 11*v*, 12*v*; and 11*w*, 12*w* can be arranged substantially along directions of the lines of the magnetic fluxes. Therefore, the 3-phase transformer Tra of the first embodiment can reduce the eddy current loss in the coil 1 (sub-coils 11 and 12).

Thus, the 3-phase transformer Tra of the first embodiment provides the 3-phase transformer Tra in which the plural sub-coils 11 and 12 are laminated in the axial direction.

Another embodiment will be described below.

Second Embodiment

Figure 4:
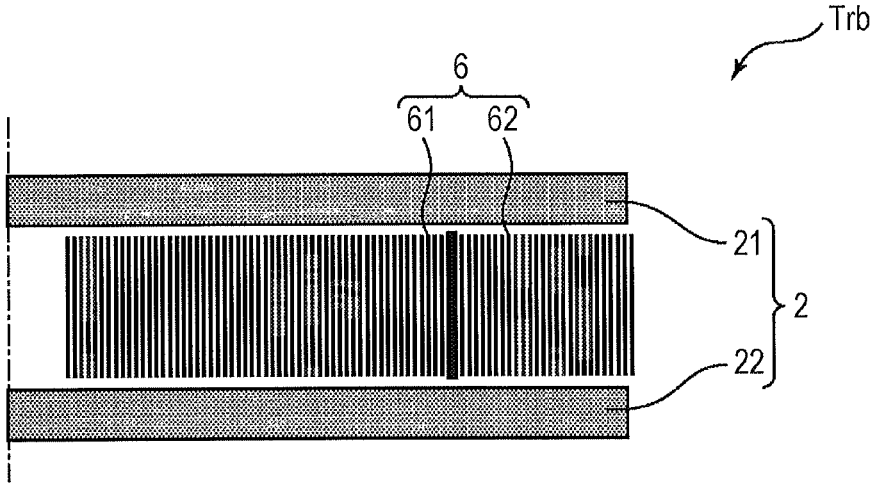
FIG. 4 is a partial sectional view of a 3-phase transformer according to a second embodiment.

FIG. 4 is a partial sectional view of a 3-phase transformer according to a second embodiment. While the 3-phase transformer Tra of the first embodiment includes a plurality of sub-coils stacked in the axial direction of the relevant coil, a 3-phase transformer Trb of the second embodiment includes a plurality of sub-coils stacked in the radial direction of the relevant coil as illustrated in FIG. 4. It is to be noted that, similarly to the relation of FIG. 2 with respect to FIG. 1, FIG. 4 illustrates a range from an axial center of one coil, e.g., a U-phase coil 6*u*, to an outer periphery thereof. Furthermore, because a top plan view of the 3-phase transformer Trb of the second embodiment is similar to that of the 3-phase transformer Tra of the first embodiment illustrated in FIG. 1, it is omitted.

The 3-phase transformer Trb of the second embodiment includes a plurality of coils 6, and magnetic members 2 for causing magnetic fluxes generated by the coils 6 to pass therethrough in a substantially concentrated way. Since the magnetic members 2 in the transformer Trb of the second embodiment are the same as the magnetic members 2 in the transformer Tra of the first embodiment, description of the former magnetic members is omitted.

As in the first embodiment, because the 3-phase transformer Trb of the second embodiment is used for 3-phase AC power having a U-phase, a V-phase, and a W-phase, the plurality of coils 6 are constituted as three coils, i.e., a U-phase coil 6*u* for use in the U-phase, a V-phase coil 6*v* for use in the V-phase, and a W-phase coil 6*w* for use in the W-phase.

Each of the three coils 6 (6*u*, 6*v*, 6*w*) includes a plurality of sub-coils. The plurality of sub-coils are each formed by winding a strip-like long conductor member in a predetermined number of times with an insulating material (not illustrated) sandwiched between turns of the conductor member. The number of plural sub-coils may be set to an optional value, e.g., a value appropriately designed depending on use of the 3-phase transformer Trb. In an example illustrated in FIG. 4, the plural sub-coils are constituted as two outer and inner coils, i.e., an outer coil 61 and an inner coil 62. The outer coil 61 and the inner coil 62 are stacked in the radial direction with the insulating material interposed therebetween.

The thus-constructed transformer Trb of the second embodiment also has a similar advantageous effect to that of the transformer Tra of the first embodiment, and the transformer Trb of the second embodiment can more easily be manufactured than the transformer of the related art. In addition, the second embodiment provides the transformer Trb including the plurality of coils 6 stacked in the radial direction.

Still another embodiment will be described below.

Third Embodiment

Figure 5:
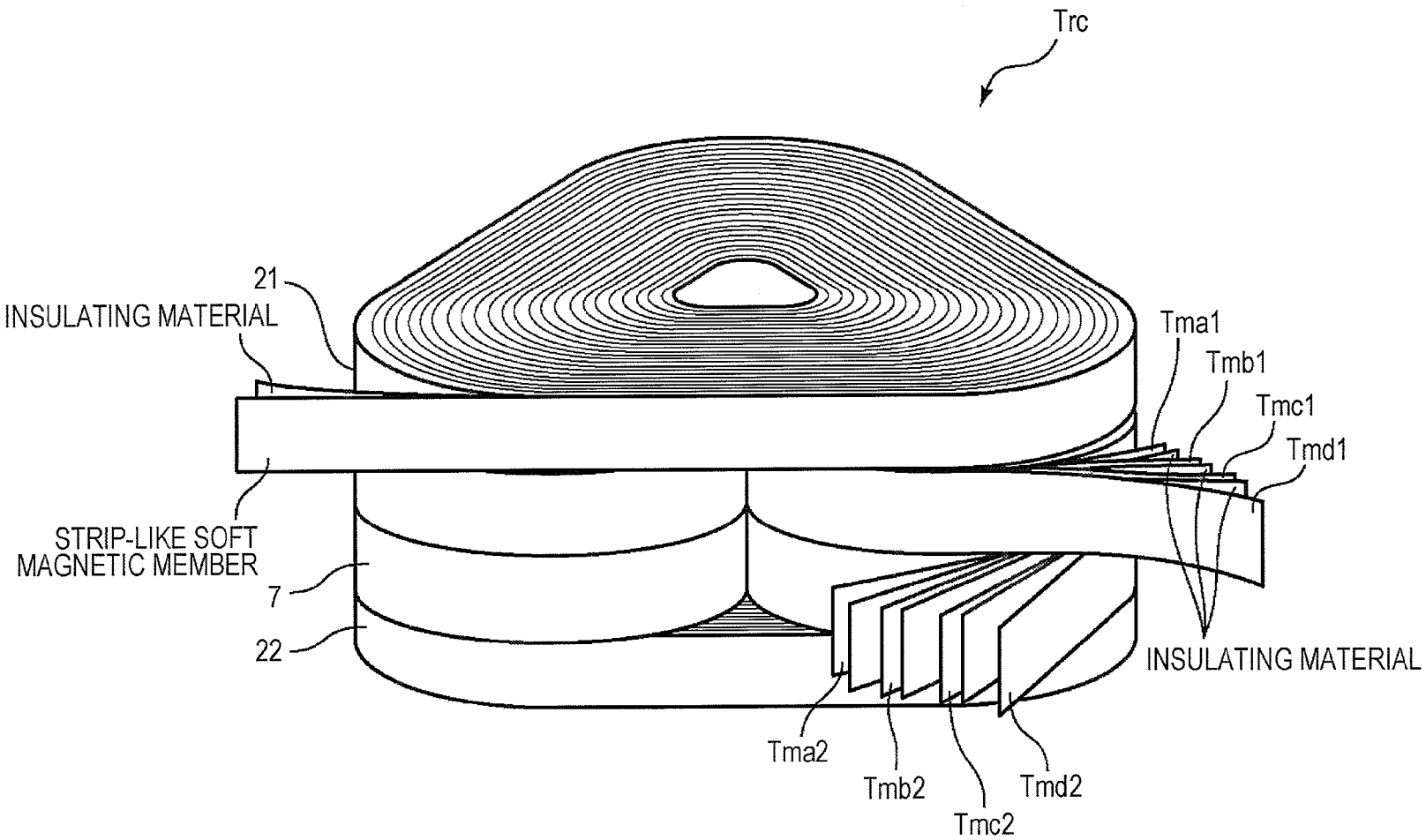
FIG. 5 is a perspective view illustrating the construction of a 3-phase transformer according to a third embodiment.
Figure 6:
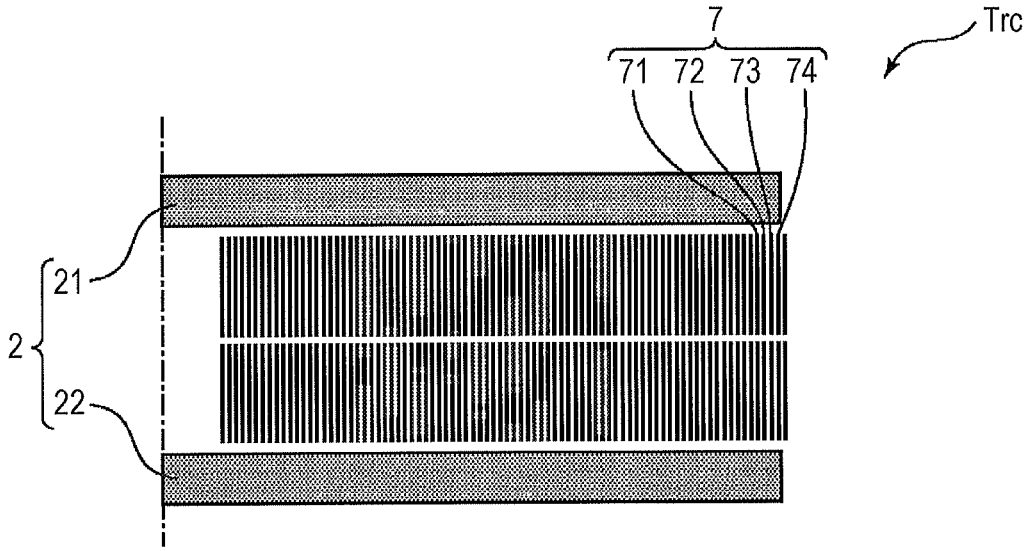
FIG. 6 is a partial sectional view of the 3-phase transformer according to the third embodiment.

FIG. 5 is a perspective view illustrating the construction of a 3-phase transformer according to a third embodiment. FIG. 6 is a partial sectional view of the 3-phase transformer according to the third embodiment.

While the 3-phase transformer Tra of the first embodiment includes the plurality of sub-coils stacked in the axial direction of the relevant coil, a 3-phase transformer Trc of the third embodiment includes a plurality of sub-coils that are each constituted, as illustrated in FIGS. 5 and 6, by winding a plurality of strip-like conductive members that are successively overlaid with an insulating material interposed therebetween. It is to be noted that, similarly to the relation of FIG. 2 with respect to FIG. 1, FIG. 6 illustrates a range from an axial center of one coil, e.g., a U-phase coil 7*u*, to an outer periphery thereof.

The 3-phase transformer Trc of the third embodiment includes a plurality of coils 7, and magnetic members 2 (21, 22) for causing magnetic fluxes generated by the coils 7 to pass therethrough in a substantially concentrated way. Since the magnetic members 2 in the transformer Trc of the third embodiment are the same as the magnetic members 2 in the transformer Tra of the first embodiment, description of the former magnetic members is omitted.

As in the first embodiment, because the 3-phase transformer Trc of the third embodiment is used for 3-phase AC power having a U-phase, a V-phase, and a W-phase, the plurality of coils 7 are constituted as three coils, i.e., a U-phase coil 7*u* for use in the U-phase, a V-phase coil 7*v* for use in the V-phase, and a W-phase coil 7*w* for use in the W-phase.

Each of the three coils 7 (7*u*, 7*v*, 7*w*) includes a plurality of sub-coils. The number of plural sub-coils may be set to an optional value, e.g., a value appropriately designed depending on specifications of the 3-phase transformer Trc. In an example illustrated in FIGS. 5 and 6, the plural sub-coils are constituted as four first and fourth sub-coils 71 to 74. The plural sub-coils 71 to 74 are each constituted, as illustrated in FIGS. 5 and 6, by winding a plurality of strip-like long conductive members (four in the third embodiment) in a predetermined number of times, which are successively overlaid with an insulating material interposed between the conductive members. While the plural sub-coils 71 to 74 may have a single-pancake structure, they have a double-pancake structure in the third embodiment, as illustrated in FIGS. 5 and 6.

Respective opposite ends Tma1, Tma2; Tmb1, Tmb2; Tmc1, Tmc2; and Tmd1, Tmd2 of the first to fourth sub-coils 71 to 74 function as connection terminals. The other end Tmb2 of the second sub-coil 72 and the one end Tmc1 of the third sub-coil 73 are electrically connected to each other, and the other end Tmc2 of the third sub-coil 73 and the one end Tmd1 of the fourth sub-coil are electrically connected to each other such that the second sub-coil 72, the third sub-coil 73, and the fourth sub-coil 74 jointly form one coil. In the 3-phase transformer Trc of an example illustrated in FIGS. 5 and 6, therefore, the first sub-coil 71 serves as a primary coil (or a secondary coil) with its opposite ends Tma1 and Tma2 being connection terminals, and the second to fourth sub-coils 72, 73 and 74 serve as a secondary coil (or a primary coil) with the one end Tmb1 of the second sub-coil 72 and the other end Tmd2 of the fourth sub-coil 74 being connection terminals.

Stated another way, given that numerals being one or more integers and differing from each other are m and n, the plural sub-coils 71 to 74 are constituted by winding a number (m+n) of strip-like conductor members that are successively overlaid with the insulating material interposed between the conductor members. The number m of conductor members are connected in series when m is 2 or more, and the number n of conductor members are connected in series when n is 2 or more. With such an arrangement, since the plural sub-coils 71 to 74 are constituted as two groups of sub-coils having a ratio of m:n, the 3-phase transformer Trc can set a voltage ratio between the two groups of sub-coils to m:n.

In the sub-coils 71 to 74 thus constituted, preferably, a thickness of each of the number m of conductor members:a thickness of each of the number n of conductor members=n:m is satisfied. With that setting, because of (m)×(thickness of each of the number m of conductor members)=(n)×(thickness of each of the number n of conductor members), respective thicknesses of the sub-coils (constituting the primary coil and the secondary coil) 71 to 74 can be made equal to each other. Thus, the transformer Tre including the sub-coils 71 to 74 of the same thickness is provided.

The above-described sub-coils 71 to 74 of the double-pancake structure can be manufactured, for example, through the following steps.

Figure 7:
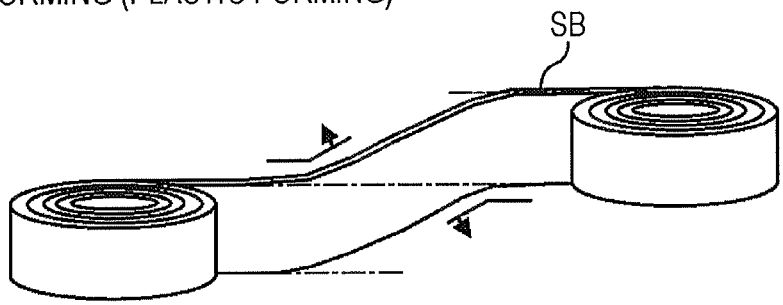
FIG. 7 is an illustration to explain a method of manufacturing a coil of double-pancake structure in the 3-phase transformer according to the third embodiment.
Figure 7:
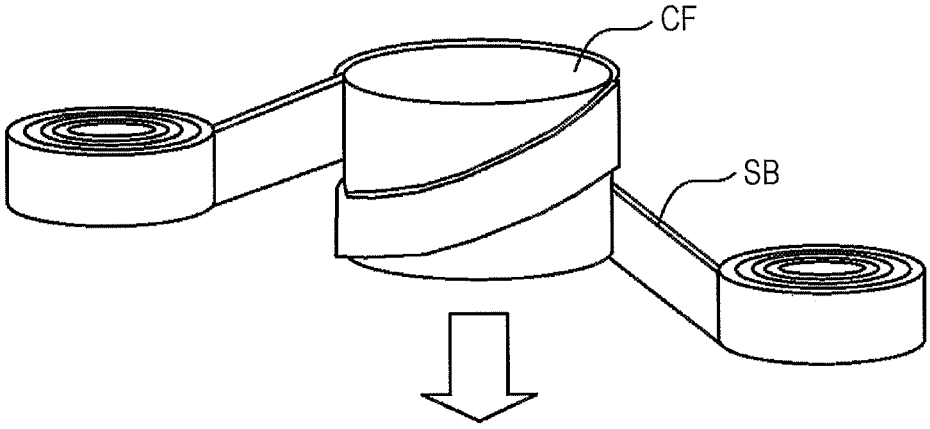
Figure 7:
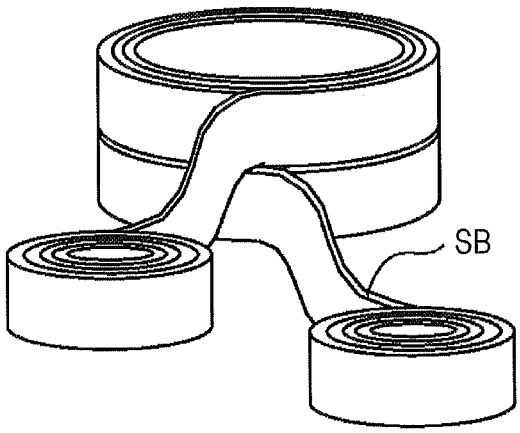

FIG. 7 is an illustration to explain a method of manufacturing the coil of the double-pancake structure in the 3-phase transformer according to the third embodiment. First, strip-like conductor members, each of which has a predetermined thickness and which is coated with an insulating film on at least one surface thereof, are prepared in number corresponding to the number of the sub-coils. The following description is made in connection with the case of manufacturing any one of the three coils 7 (7*u*, 7*v*, 7*w*) in the 3-phase transformer Trc in the example illustrated in FIGS. 5 and 6. In that case, four conductor members are prepared to fabricate the sub-coils 71 to 74. As a matter of course, the following steps can similarly be performed for any desired number of conductor members. The four conductor members coated with insulating films are successively overlaid (stacked in order) with electrical insulation therebetween by the insulating materials. Then, as illustrated in FIG. 7(A), the four overlaid conductor members (called "overlaid conductor members SB") are wound from each of both the ends, and an intermediate portion thereof is bent by plastic forming, for example, through a predetermined angle in a plane including the strip-like overlaid conductor members SB in a direction (widthwise direction) perpendicular to a lengthwise direction of the conductor members. Then, as illustrated in FIG. 7(B), the bent portion is brought into contact with an outer peripheral surface of a central bobbin CF, and the overlaid conductor members SB are wound over the outer peripheral surface of the central bobbin CF in a predetermined number of times, starting from the contact point, into the form of DP (double-pancake) winding with the central bobbin CF serving as a bobbin for the winding. After the winding of the overlaid conductor members SB around the central bobbin CF, as illustrated in FIG. 7(C), the central bobbin CF is withdrawn out, whereby the U-phase coil 7*u* made up of the first to fourth sub-coils 71 to 74 is formed. Portions remained after winding the overlaid conductor members SB become the respective connection terminals Tma1, Tma2; Tmb1, Tmb2; Tmc1, Tmc2; and Tmd1, Tmd2 of the first to fourth sub-coils 71, 72, 73 and 74. Then, the connection terminals Tmb1, Tmb2; Tmc1, Tmc2; and Tmd1, Tmd2 are connected, as described above, in order that the second to fourth sub-coils 72, 73 and 74 jointly form one coil. Through the above-described procedures, the plural sub-coils 71 to 74 of the double-pancake structure are fabricated.

The thus-constructed transformer Trc of the third embodiment also has a similar advantageous effect to that of the transformer Tra of the first embodiment. In particular, since the plural sub-coils 71 to 74 can be fabricated in one winding step, the transformer Trc of the third embodiment can more easily be manufactured than the transformer of the related art.

Still another embodiment will be described below.

Fourth Embodiment

Figure 8:
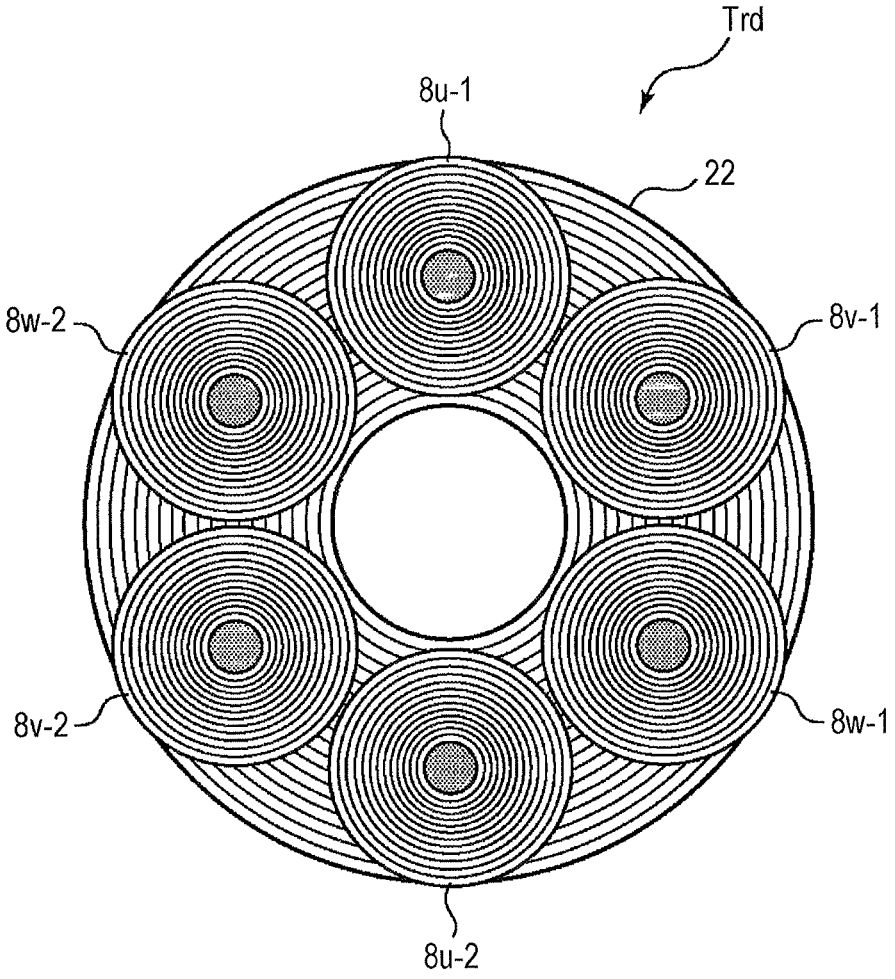
FIG. 8 illustrates the construction of a 3-phase transformer according to a fourth embodiment.
Figure 9:
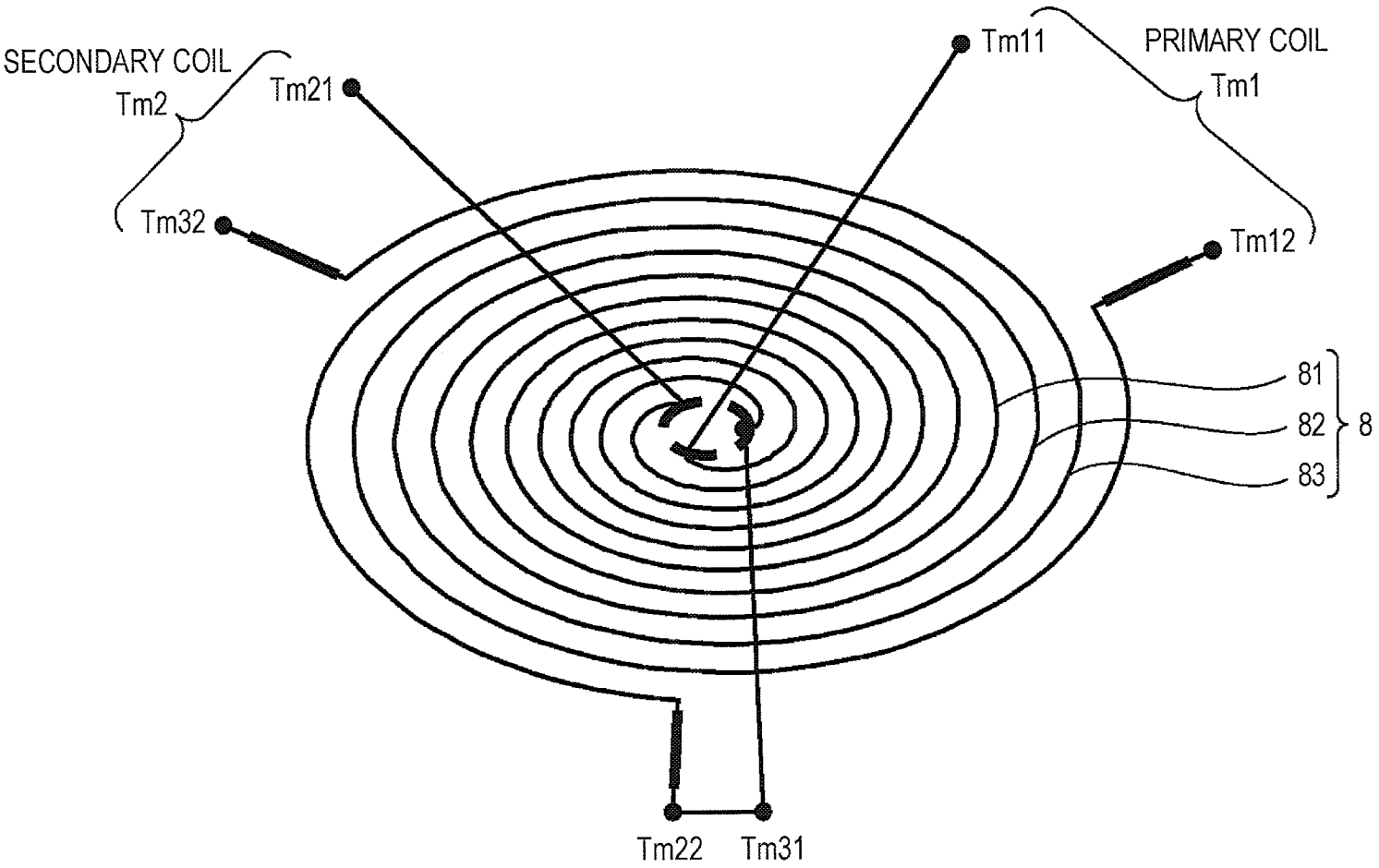
FIG. 9 is an illustration to explain a connected state of coils in the 3-phase transformer according to the fourth embodiment.

FIG. 8 illustrates the construction of a 3-phase transformer according to a fourth embodiment. FIG. 9 is an illustration to explain a connected state of coils in the 3-phase transformer according to the fourth embodiment.

While the 3-phase transformer Tra of the first embodiment includes the plurality of sub-coils stacked in the axial direction of the relevant coil, a 3-phase transformer Trd of the fourth embodiment includes, as illustrated in FIG. 8, a plurality of coils 8 (8*u*-1, 8*u*-2; 8*v*-1, 8*v*-2; 8*w*-1, 8*w*-2) disposed side by side on the same plane such that respective axial directions of the plural coils 8 are parallel to each other. It is to be noted that FIG. 8 is a top plan view of the 3-phase transformer Trd of the fourth embodiment in a state where one magnetic member 21 is removed.

The 3-phase transformer Trd of the fourth embodiment includes a plurality of coils 8, and magnetic members 2 for causing magnetic fluxes generated by the coils 8 to pass therethrough in a substantially concentrated way. Since the magnetic members 2 in the transformer Trd of the fourth embodiment are the same as the magnetic members 2 (21, 22) in the transformer Tra of the first embodiment except for having a donut-shaped cross-section instead of the substantially regular-triangular cross-section in the first embodiment, description of the former magnetic members is omitted.

As in the first embodiment, because the 3-phase transformer Trd of the fourth embodiment is used for 3-phase AC power having a U-phase, a V-phase, and a W-phase, the plurality of coils 8 are constituted as a U-phase coil 8*u* for use in the U-phase, a V-phase coil 8*v* for use in the V-phase, and a W-phase coil 8*w* for use in the W-phase. Furthermore, in the fourth embodiment, the U-phase coil 8*u*, the V-phase coil 8*v*, and the W-phase coil 8*w* are each made up of plural coils, and the plural U-phase coils 8*u*, the plural V-phase coils 8*v*, and the plural W-phase coils 8*w* are successively disposed side by side and are arrayed in an annular pattern such that respective axial directions of all the coils 8 are parallel to one another and respective one ends thereof on each side are positioned on the same plane. In an example illustrated in FIG. 8, each of the coils 8*u*, 8*v* and 8*w* in the respective phases includes two first and second coils. More specifically, the U-phase coil 8*u* includes a first U-phase coil 8*u*-1 and a second U-phase coil 8*u*-2. The V-phase coil 8*v* includes a first V-phase coil 8*v*-1 and a second V-phase coil 8*v*-2. The W-phase coil 8*w* includes a first W-phase coil 8*w*-1 and a second W-phase coil 8*w*-2.

While each of the first and second coils 8*u*-1, 8*u*-2; 8*v*-1, 8*v*-2; and 8*w*-1, 8*w*-2 in the respective phases may have any of the structures of the coils 1, 6 and 7 in the 3-phase transformers Tra to Trc of the first to third embodiments, the example illustrated in FIG. 8 employs the structure of the coil 7 in the 3-phase transformer Trc of the third embodiment. In other words, each of the coils 8*u*-1, 8*u*-2; 8*v*-1, 8*v*-2; and 8*w*-1, 8*w*-2 in the 3-phase transformer Trd of the fourth embodiment includes a plurality of sub-coils. The number of plural sub-coils may be set to an optional value, e.g., a value appropriately designed depending on specifications of the 3-phase transformer Trd. In the example illustrated in FIGS. 8 and 9, the plural sub-coils are constituted as three first to third sub-coils 81 to 83. Those plural sub-coils 81 to 83 are formed by winding a plurality (three in the fourth embodiment) of strip-like long conductor members in a predetermined number of times, the conductor members being successively overlaid with an insulating material (not illustrated) sandwiched between adjacent two of the conductor members. Furthermore, in the fourth embodiment, the coils 8*u*-1, 8*u*-2; 8*v*-1, 8*v*-2; and 8*w*-1, 8*w*-2 are each in the form of a single-pancake structure.

As illustrated in FIG. 9, respective opposite ends Tm11, Tm12; Tm21, Tm22; and Tm31, Tm32 of the first to third sub-coils 81, 82 and 83 function as connection terminals. The other end Tm22 of the second sub-coil 82 and the one end Tm31 of the third sub-coil 83 are electrically connected to each other such that the second sub-coil 82 and the third sub-coil 83 jointly form one coil. In the 3-phase transformer Trd of the example illustrated in FIGS. 8 and 9, therefore, the first sub-coil 81 serves as a primary coil (or a secondary coil) with its opposite ends Tm11 and Tm12 being connection terminals, and the second and third sub-coils 82 and 83 serve as a secondary coil (or a primary coil) with the one end Tm21 of the second sub-coil 82 and the other end Tm32 of the third sub-coil 83 being connection terminals.

The thus-constructed transformer Trd of the fourth embodiment also has a similar advantageous effect to that of the transformer Tra of the first embodiment, and the transformer Trd of the fourth embodiment can more easily be manufactured than the transformer of the related art. In addition, the fourth embodiment can provide the 3-phase transformer including the plurality of coils 8*u*, 8*v* and 8*w* that are disposed side by side.

Still another embodiment will be described below.

Fifth Embodiment

Figure 10:
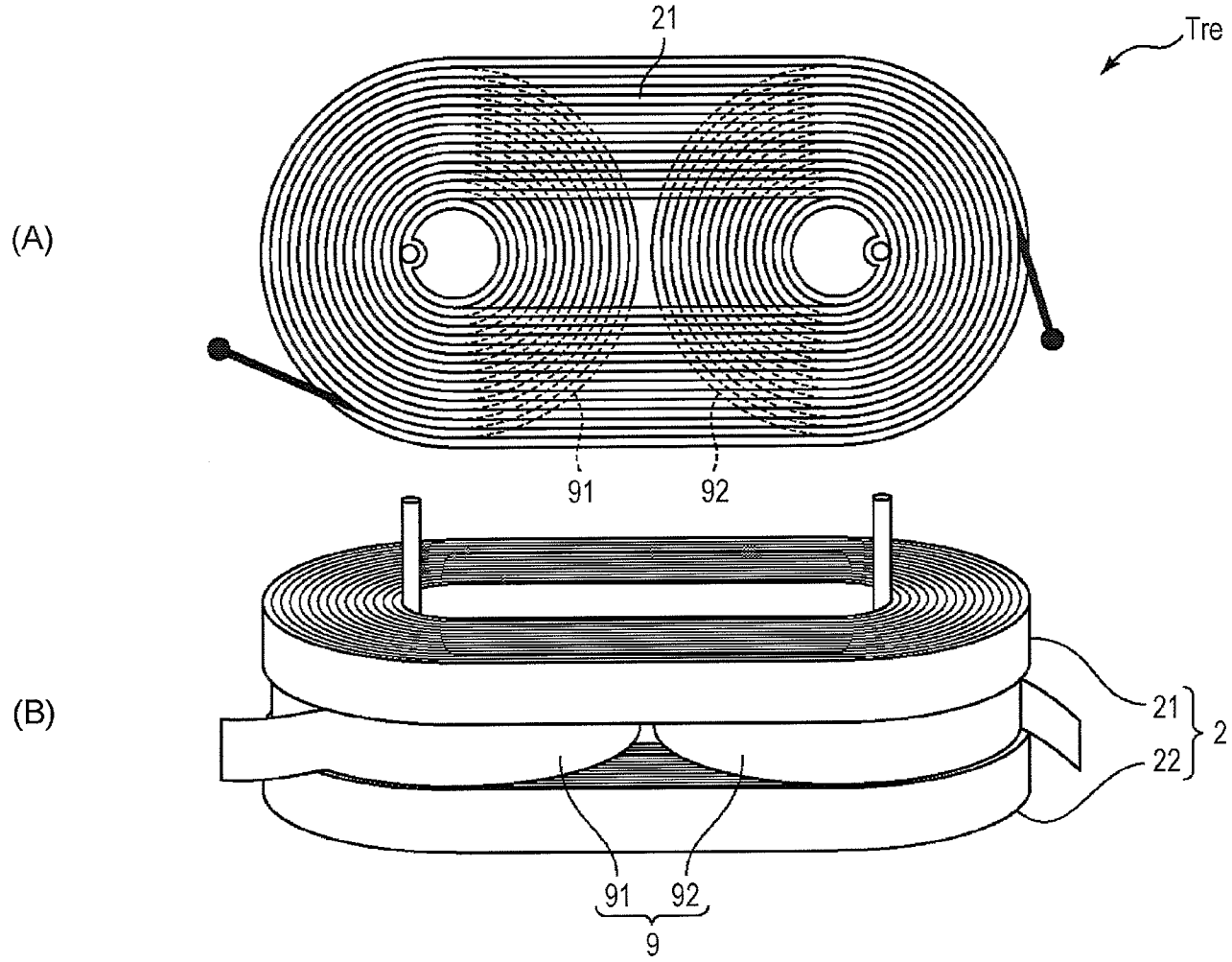
FIG. 10 illustrates the construction of a single-phase transformer according to a fifth embodiment.

FIG. 10 illustrates the construction of a single-phase transformer according to a fifth embodiment. FIG. 10(A) is a top plan view of the single-phase transformer, and FIG. 10(B) is a perspective view thereof. While the first to fourth embodiments relate to the multi-phase transformers Tra to Trd, the transformer of the fifth embodiment is a single-phase transformer based on a similar concept to that of the multi-phase transformers Tra to Trd of the first to fourth embodiments.

A single-phase transformer Tre of the fifth embodiment includes a plurality of coils 9 including a primary coil 91 and a secondary coil 92, and magnetic members 2 (21, 22) for causing magnetic fluxes generated by the primary coil 91 and the secondary coil 92 to pass therethrough in a substantially concentrated way.

The primary coil 91 may be constituted, for example, by winding a conductive wire having, e.g., a circular or square sectional shape and coated with an insulating film. In the fifth embodiment, however, the primary coil 91 is constituted, similarly to the first and second sub-coils in the first to fourth embodiments, by winding a strip-like conductor member such that a widthwise direction of the conductor member is aligned with an axial direction of the primary coil 91. More specifically, the primary coil 91 is formed by winding a strip-like conductor member, which is coated with an insulating film on one surface thereof, in a predetermined number of times into a spiral shape, i.e., into the form of the so-called single-pancake winding. Alternately, the primary coil 91 is formed by winding the strip-like conductor member, with a comparatively thin insulating sheet interposed between turns of the conductor member, in a predetermined number of times into a spiral shape, i.e., into the form of the so-called single-pancake winding. The secondary coil 92 is also constituted in a similar manner to the primary coil 91.

The magnetic members 2 include, like the magnetic members 2 in the first to fourth embodiments, a pair of members 21 and 22 disposed at respective axial opposite ends of the plural coils 9 (91, 92) so as to cover those opposite ends. In other words, the single-phase transformer Tre of the fifth embodiment has a structure of sandwiching the plural coils 9 (91, 92) in the axial direction thereof between the pair of magnetic members 21 and 22. The magnetic members 2 (21, 22) each has a predetermined magnetic characteristic (magnetic permeability) depending on, e.g., specifications, etc. The magnetic members are constituted by winding strip-like soft magnetic members such that widthwise directions of the soft magnetic members are aligned with the axial directions of the plural coils 9 (91, 92). More specifically, the pair of magnetic members 21 and 22 are each formed by winding a strip-like soft magnetic member, which is coated with an insulating film on one surface thereof, into a spiral shape, i.e., into the form of the so-called single-pancake winding. Alternately, the pair of magnetic members 21 and 22 are each formed by winding the strip-like conductor member, with a comparatively thin insulating sheet interposed between turns of the conductor member, in a predetermined number of times into a spiral shape, i.e., into the form of the so-called single-pancake winding.

The primary coil 91 and the secondary coil 92 are disposed side by side such that respective axial directions of the coils 9 (91, 92) are parallel to one another, that respective one ends thereof on each side are positioned on the same plane, and that the coils 9 are adjacent to each other with a predetermined spacing held therebetween. Corresponding to such an arrangement of the coils 9, in the fifth embodiment, each of the magnetic members 2 has a horizontal cross-section in an oblong shape having parallel portions (i.e., a shape obtained by interconnecting opposed ends of a ⊂-shape and ⊃-shape).

The single-phase transformer Tre thus constructed has a structure of sandwiching the primary coil 91 and the secondary coil 92 between the pair of magnetic members 2 (21, 22). Therefore, when AC power is supplied to the primary coil 91, a magnetic field is formed by the primary coil 91, and magnetic flux of the magnetic field generated by the primary coil 91 extends from the primary coil 91 to pass through the one magnetic member 21, through the secondary coil 92, and further through the other magnetic member 22 for return to the primary coil 91. Accordingly, the secondary coil 92 is magnetically coupled to the primary coil 91 through the pair of magnetic members 21 and 22, whereby the AC power supplied to the primary coil 91 is transmitted to the secondary coil 92 with electromagnetic induction and a predetermined voltage is induced therein. The pair of magnetic members 21 and 22 functions as a part of a magnetic circuit for returning the magnetic flux generated by the primary coil 91 and coupling the primary coil 91 and the secondary coil 92 to each other with mutual inductance. The single-phase transformer Tre having the above-described construction does not need cores that are arranged to surround respective lateral surfaces of the coils 9 (91, 92), and it is no longer required to form the primary coil and the secondary coil by winding the wires around the annular core unlike the related art described in the background art. As a result, the single-phase transformer Tre having the above-described construction can more easily be manufactured than the transformer of the related art.

Furthermore, the single-phase transformer Tre has the structure in which the magnetic members 2 sandwich the coils 91 and 92 between two planes having normal directions aligned with the axial directions of the coils 91 and 92. In addition, the primary coil 91 and the secondary coil 92 are each constituted by winding the strip-like conductor member such that the widthwise direction of the conductor member is aligned with the axial direction of the coil 91 or 92. In a space between the pair of magnetic members 21 and 22, therefore, the conductor members of the primary coil 91 and the secondary coil 92 are positioned along the lines of the magnetic fluxes. Accordingly, eddy current losses in the conductor members of the primary coil 91 and the secondary coil 92 are reduced.

While, in the first to fifth embodiments described above, the magnetic members 2 are each formed by winding the strip-like soft magnetic member, they may be formed by shaping soft magnetic powder from the viewpoint of easiness in shaping into a desired shape. When the multi-phase transformers Tr (Tra, Trb, Trc, Trd) and the single-phase transformer Tre are constituted using the soft magnetic powder, the magnetic members 2 can easily be formed and iron losses of the magnetic members 2 can also be reduced. As an alternative, the magnetic members 2 may be formed by shaping a mixture of soft magnetic powder and nonmagnetic powder. Because a mixing ratio between the soft magnetic powder and the nonmagnetic powder can comparatively easily be adjusted, the predetermined magnetic characteristics of the magnetic members 2 can easily be set to respective desired magnetic characteristics by appropriately adjusting the mixing ratio.

The above-mentioned soft magnetic powder is ferromagnetic metal powder. More specifically, the soft magnetic powder is, e.g., pure iron powder, iron-based alloy powder (such as a Fe—Al alloy, a Fe—Si alloy, cendust, or permalloy), amorphous powder, or iron powder having an electrically-insulating coating, e.g., a phosphate-based conversion coating, formed on the surface thereof. Those soft magnetic powders can be produced by known means, such as a method of obtaining microparticles with, e.g., atomization, or a method of finely pulverizing, e.g., iron oxide and reducing the pulverized powder. In particular, the soft magnetic powder is preferably made of a metal-based material, e.g., the pure iron powder, the iron-based alloy powder, or the amorphous powder, for the reason that the metal-based material generally has a larger saturation magnetic flux density when magnetic permeability is the same. The magnetic member 2 made of the above-mentioned soft magnetic powder can be formed by known ordinary means, e.g., compacting.

In the first to fifth embodiments described above, a gap between each of the plural coils 1, 6, 7, 8 and 9 and the magnetic member 2 may be filled with a heat transfer member. With the multi-phase transformers Tr (Tra, Trb, Trc, Trd) and the single-phase transformer Tre of that type, since the above-mentioned gap is filled with the heat transfer member, heat generated by the coils 1, 6, 7, 8 and 9 can be transferred to the magnetic member 2 through the heat transfer member. Therefore, the multi-phase transformers Tr (Tra, Trb, Trc, Trd) and the single-phase transformer Tre of that type can improve a heat dissipation effect. The heat transfer member is, for example, a high-molecular member having comparatively good thermal conductivity (i.e., a high-molecular member having a comparatively high coefficient of thermal conductivity). The high-molecular member is, for example, an epoxy-based resin having good adhesion. The coils 1, 6, 7 and 8 are each substantially fixed to the magnetic members 2 with the above-mentioned high-molecular members. The multi-phase transformers Tr (Tra, Trb, Trc, Trd) and the single-phase transformer Tre of that type can also reduce vibration caused by magnetostriction. As another example, the heat transfer member may be an insulating material, e.g., a BN ceramic (boron nitride ceramic), or may be a compound filled into the above-mentioned gap. Such an example of the heat transfer member can further improve insulation performance.

In the first to fifth embodiments described above, a thickness of the conductor member in each of the coils 1, 6, 7, 8 and 9 is desirably ⅓ or less of the skin depth at the frequency of the AC power supplied to the multi-phase transformers Tr (Tra, Trb, Trc, Trd) and the single-phase transformer Tre. The multi-phase transformers Tr (Tra, Trb, Trc, Trd) and the single-phase transformer Tre of that type can reduce the eddy current loss. In general, a current flowing through a coil flows just in a region up to the skin depth 6 instead of evenly flowing over the entire cross-section of a conductor. Accordingly, the eddy current loss can be reduced by setting the thickness t of the conductor member to be not larger than the skin depth $\delta$. Given that the angular frequency of the AC power is $\omega$, the magnetic permeability of the conductor member is $\mu$, and the electrical conductivity of the conductor member is $\rho$, the skin depth $\delta$ is generally expressed by $\delta=(2/\omega\mu\rho)^{1/2}$.

In the first to fourth embodiments described above, the multi-phase transformers Tr (Tra, Trb, Trc, Trd) include, by way of example, the 3-phase transformers Tr including the respective three coils 1, 6, 7 and 8 in the U-phase, the V-phase, and the W-phase to be adapted for the 3-phase AC power, the present invention is not limited to those embodiments, and the transformers Tr may be adapted for another different number of phases. The multi-phase transformers Tr (Tra, Trb, Trc, Trd) may be each, e.g., a two-phase transformer Tr adapted for two phases.

A transformation system may be constituted by employing a plurality of transformers connected in series, which include at least one of the multi-phase transformers Tr (Tra, Trb, Trc, Trd) and the single-phase transformer Tre. Since such a transformation system is constituted by multiple stages of transformers to be capable of successively transforming a voltage by the individual transformers, it is possible to reduce a voltage applied to one transformer, to ensure effective protection against dielectric breakdown, and to reduce a load per transformer.

Figure 12:
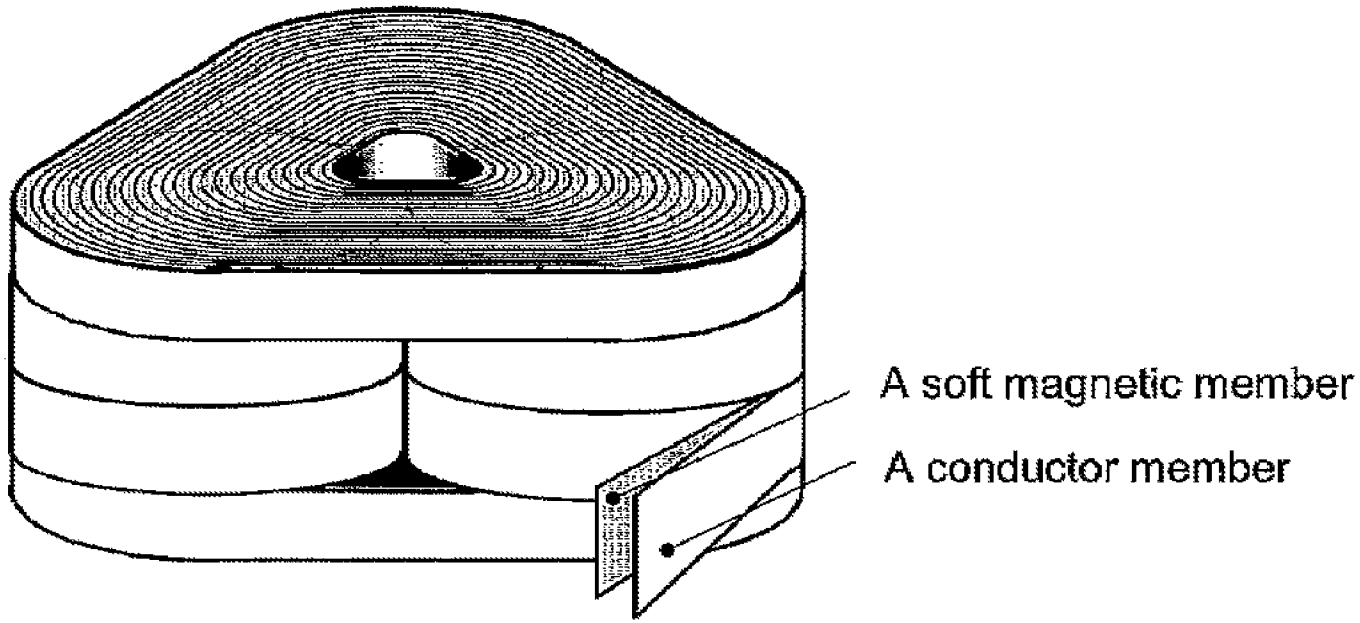
FIG. 12 is an illustration of the conductor member that includes a soft magnetic member disposed on one lateral surface of the conductor member according to at least one embodiment.

In the first to fifth embodiments described above and modifications thereof, each of the conductor members in the first and second sub-coils 11, 12; 61, 62; 71, 72; and 81, 82, the primary coil 91, and the secondary coil 92 may further include a soft magnetic member disposed on one lateral surface of the conductor member, the lateral surface being faced perpendicularly to the axial direction of corresponding one of the plural coils 1, 6, 7, 8 and 9, as shown in FIG. 12. With such an arrangement, because the soft magnetic member is disposed on one lateral surface of the conductor member, the one lateral surface being faced perpendicularly to the axial direction, the magnetic permeability in each of the plural coils 1, 6, 7, 8 and 9 is increased, whereby an inductance can be increased and a loss can be suppressed. Thus, a transformer having a larger inductance and a lower loss can be provided by employing the plural coils 1, 6, 7, 8 or 9 constructed as described above.

Figure 11:
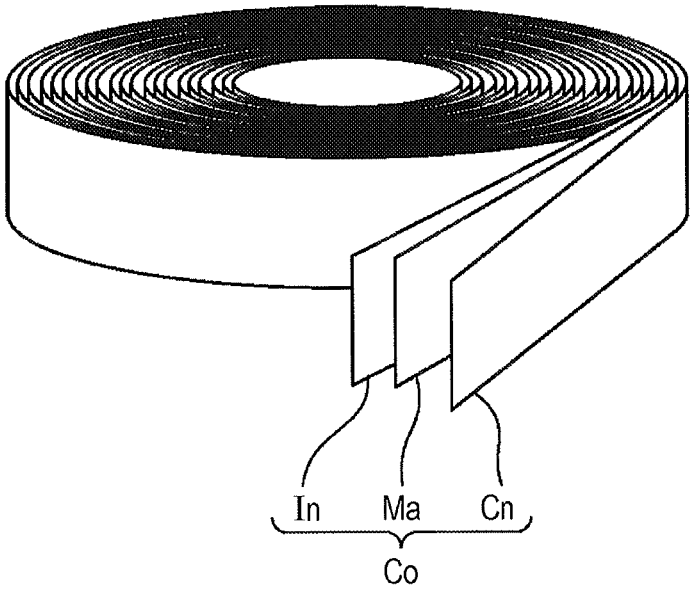
FIG. 11 is an illustration to explain the construction of a coil portion in a modification.

FIG. 11 is an illustration to explain the construction of a coil portion in the modification. FIG. 11 illustrates a part of a coil Co in any of the first and second sub-coils 11, 12; 61, 62; 71, 72; and 81, 82, the primary coil 91, and the secondary coil 92 according to the modification.

More specifically, in each of the above-described plural coils 1, 6, 7, 8 and 9 according to the modification, the coil Co includes, as illustrated in FIG. 11, a strip-like long conductor member Cn made of a predetermined material, a soft magnetic member Ma made of a predetermined material and disposed on one lateral surface of the conductor member Cn, the one lateral surface being faced perpendicularly to the axial direction, and an insulating material In made of a predetermined material and disposed on the one lateral surface of the conductor member Cn, the one lateral surface being faced perpendicularly to the axial direction, with the soft magnetic member Ma being interposed between the conductor member Cn and the insulating material In. The conductor member Cn, the soft magnetic member Ma, and the insulating material In are wound together to be successively layered. Stated another way, the conductor member Cn, the soft magnetic member Ma, and the insulating material In are successively overlaid into a bundle and are wound together into a spiral shape.

Regarding the first embodiment, a modification of each pair of the first and second sub-coils 11 and 12 of the first embodiment is constituted by stacking two coils in the axial direction thereof, which are formed by winding the conductor member Cn, the soft magnetic member Ma, and the insulating material In together to be successively layered. Regarding the second embodiment, a modification of each pair of the first and second sub-coils 61 and 62 of the second embodiment is constituted by stacking two coils in the radial direction thereof, which are formed by winding the conductor member Cn, the soft magnetic member Ma, and the insulating material In together to be successively layered. Regarding the third embodiment, a modification of the first and second sub-coils 71, 72, 73 and 74 of the third embodiment is constituted by successively overlaying four sets of the conductor member Cn, the soft magnetic member Ma, and the insulating material In, and further by winding them together to be successively layered. The first and second sub-coils 81, 82 and 83 of the fourth embodiment and the primary coil 91 and the secondary coil 92 of the fifth embodiment can also be constituted in a similar manner.

For example, the soft magnetic member Ma may be disposed on one lateral surface of the conductor member Cn by successively overlaying, on a strip-like long copper tape, a similar strip-like long iron tape and a similar strip-like long insulating material tape. Alternatively, the soft magnetic member Ma may be disposed on one lateral surface of the conductor member Cn by coating a layer of the soft magnetic member Ma on the conductor member Cn with, e.g., plating (such as electrolytic plating) or vapor deposition. For example, iron is plated on a copper tape. As an alternative, the soft magnetic member Ma may be disposed on one lateral surface of the conductor member Cn by press-bonding the soft magnetic member Ma thereto with, e.g., thermal compression bonding. For example, a press-bonded tape of copper and iron is formed by overlaying a copper tape on an iron tape, and by applying a load to them under heating. In the above-mentioned cases, the copper is one example of the conductor member Cn, and the iron is one example of the soft magnetic member Ma. In the copper tape including a layer (thin film) of iron formed on one lateral surface thereof, because electrical conductivity of copper is larger than that of iron approximately by an order of magnitude, a current primarily flows through a copper portion. While, in the above-described modifications, the soft magnetic member Ma is directly disposed on one lateral surface of the conductor member Cn, it may be indirectly disposed on one lateral surface of the conductor member Cn with an insulating material interposed therebetween.

Figure 13:
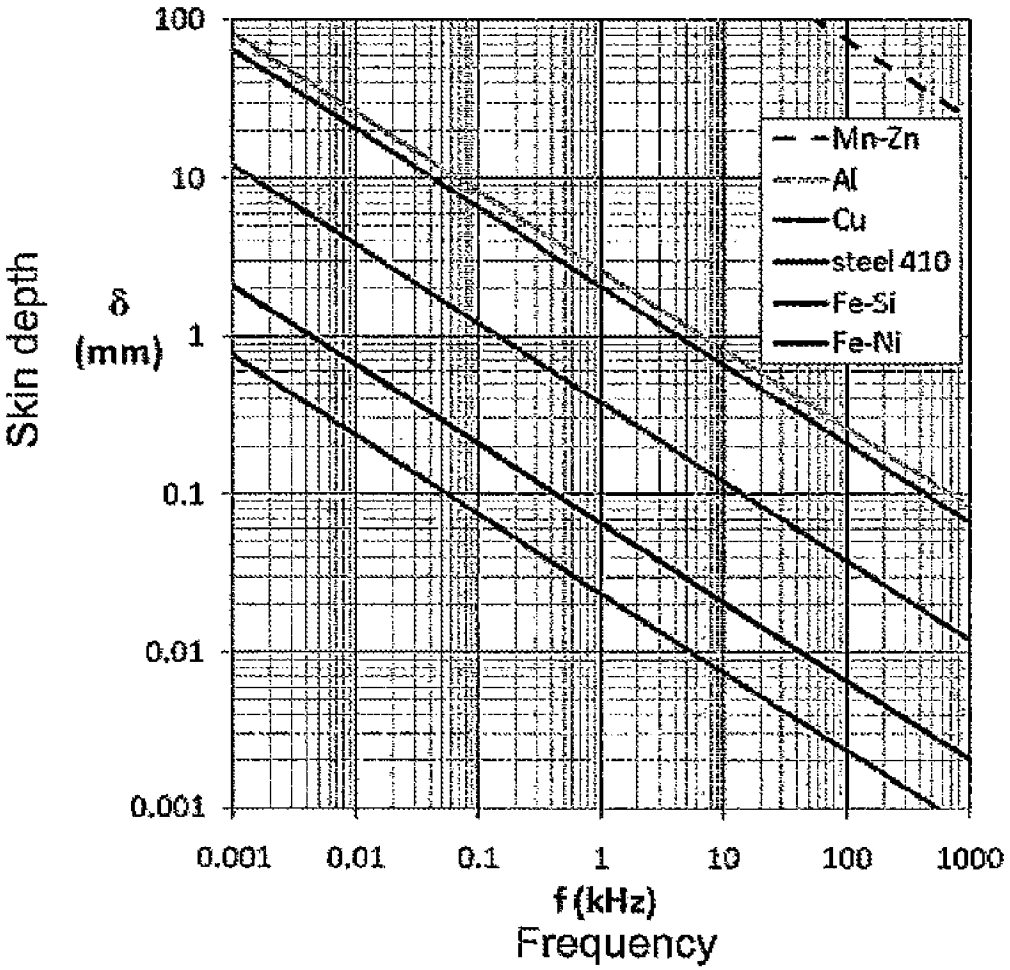
FIG. 13 is an illustration of the thickness of the soft magnetic member according to at least one embodiment.

As shown in FIG. 13, a thickness of the soft magnetic member Ma (i.e., a thickness of the soft magnetic member Ma in the direction perpendicular to the axial direction mentioned above) is preferably not larger than the skin depth δ at the frequency of the AC power supplied to the coil Co. That setting can reduce generation of the eddy current loss.

A width (axial length) of the conductor member Cn and a width (axial length) of the soft magnetic member Ma may be the same (matched with each other) or different from each other. Preferably, the width of the soft magnetic member Ma is larger than the width of the conductor member Cn such that both ends of the soft magnetic member Ma are contacted with the magnetic coupling members 2 (21, 22).

In order to increase the inductance in the first to fifth embodiments, the number of windings (i.e., the number of turns) in each of the plural coils 1, 6, 7, 8 and 9 has to be increased, whereby a larger amount of the conductor member is required and an apparatus size is increased. By employing the above-described construction of this modification, however, it is possible to suppress not only an increase of the amount of the conductor member required, but also an increase of the apparatus size. For example, when a coil is formed using a copper tape, the inductance of the coil can be increased just by using a pure iron-based material that is comparatively inexpensive. Furthermore, in this modification, since the soft magnetic member Ma is disposed in each of the plural coils 1, 6, 7, 8 and 9, the lines of magnetic fluxes are dispersed to each of the coils 1, 6, 7, 8 and 9 as well. This reduces the magnetic flux density, whereby an increase of a hysteresis loss specific to the pure iron-based material can be effectively suppressed and a lower loss can be realized. As a result, a transformer having a larger inductance and a lower loss can be provided.

In this modification, when the coil is constituted as a cored coil including a magnetic coupling member in its core portion, the magnetic coupling member preferably has magnetic permeability that is equivalent to average magnetic permeability of the coil including the soft magnetic member. The magnetic coupling member having such magnetic permeability is formed, for example, by compacting the above-mentioned soft magnetic powder. Even in the cored coil, with the provision of the magnetic coupling member disposed in the core portion, it is possible to maintain not only the dispersion of the lines of magnetic fluxes to each of the plural coils 1, 6, 7, 8 and 9, but also the effect of suppressing the increase of a hysteresis loss specific to the pure iron-based material.

While this description discloses techniques in various aspects as described above, primary techniques among them are as follows.

A multi-phase transformer according to a first aspect includes a plurality of coils, and a pair of magnetic members disposed at respective opposite ends of the plural coils in axial directions thereof, wherein each of the plural coils includes a plurality of sub-coils.

Since the multi-phase transformer thus constructed has the structure of sandwiching the plural coils between the pair of magnetic members, magnetic flux generated by one of the plural coils passes through the magnetic member disposed at one end of the one coil, through the other coil(s), and through the magnetic member disposed at the other end of the one coil for return to the one coil. In the multi-phase transformer thus constructed, therefore, lines of magnetic fluxes generated by the plural coils are canceled at upper and lower ends of the coils. Hence, the multi-phase transformer having the above-described construction does not need cores that are arranged to surround respective lateral surfaces of the coils, and it is no longer required to form the sub-coils, which function as the primary coil, the secondary coil, etc., by winding the wires around the annular core unlike the related art described in the background art. As a result, the multi-phase transformer having the above-described construction can more easily be manufactured than the transformer of the related art.

According to another aspect, in the multi-phase transformer described above, the magnetic members are formed using soft magnetic powder.

With that feature, since the magnetic members are formed using soft magnetic powder, the magnetic members can easily be formed and an iron loss can be reduced in the transformer having that feature.

According to still another aspect, in the multi-phase transformer described above, the magnetic members are formed by winding strip-like soft magnetic members such that widthwise directions of the soft magnetic members are aligned with the axial directions of the plural coils.

With that feature, since the magnetic members can be fabricated by winding the strip-like soft magnetic members, the multi-phase transformer having that feature can easily be manufactured in various sizes ranging from a small size, of course, to a large size.

According to still another aspect, the multi-phase transformer described above further includes an insulating layer between turns of the wound soft magnetic member.

With that feature, since electrical resistance in the radial direction is increased, an eddy current loss in the magnetic member can be reduced in the multi-phase transformer having that feature.

According to still another aspect, in any of the multi-phase transformers described above, each of the plural sub-coils is constituted by winding a strip-like conductor member such that a widthwise direction of the conductor member is aligned with the axial direction of the corresponding coil.

With that feature, since each of the sub-coils is constituted by winding the strip-like long conductor member such that the widthwise direction of the conductor member is aligned with the axial direction of the coil made up of those sub-coils, the conductor member of each sub-coil can be arranged substantially along lines of magnetic fluxes when the magnetic members have a structure sandwiching the plural coils between two planes that have normal directions aligned with the axial directions of the coils. Accordingly, the multi-phase transformer having the above-described feature can reduce eddy current losses in the coils (sub-coils).

According to still another aspect, in the multi-phase transformer described above, the conductor member includes a soft magnetic member disposed on one lateral surface of the conductor member, the one lateral surface being faced perpendicularly to the axial direction.

With that feature, since the soft magnetic member is disposed on one lateral surface of the conductor member, the one lateral surface being faced perpendicularly to the axial direction, it is possible to further increase magnetic permeability in the plural sub-coils, to increase inductance, and to suppress a loss. As a result, the multi-phase transformer having a larger inductance and a lower loss is provided.

According to still another aspect, in the multi-phase transformer described above, a thickness of the soft magnetic member in a direction perpendicular to the axial direction is not larger than a skin depth at a frequency of AC power that is supplied to the multi-phase transformer.

The multi-phase transformer having that feature can reduce generation of the eddy current loss.

According to still another aspect, in any of the multi-phase transformers described above, the soft magnetic member is coated over the conductor member.

With that feature, the multi-phase transformer including the soft magnetic member disposed on one lateral surface of the conductor member, the one lateral surface being faced perpendicularly to the axial direction, can more simply and easily be manufactured by winding the conductor member coated with the soft magnetic member.

According to still another aspect, in any of the multi-phase transformers described above, the soft magnetic member is press-bonded to the conductor member.

With that feature, the multi-phase transformer including the soft magnetic member disposed on one lateral surface of the conductor member, the one lateral surface being faced perpendicularly to the axial direction, can more simply and easily be manufactured by winding the conductor member to which the soft magnetic member is press-bonded.

According to still another aspect, in any of the multi-phase transformers described above, the plural sub-coils are stacked in the axial direction of the corresponding coil.

With that feature, the multi-phase transformer including the plural sub-coils stacked in the axial direction is provided.

According to still another aspect, in any of the multi-phase transformers described above, the plural sub-coils are stacked in a radial direction of the corresponding coil.

With that feature, the multi-phase transformer including the plural sub-coils stacked in the radial direction is provided.

According to still another aspect, in any of the multi-phase transformers described above, the plural sub-coils are each formed by winding a plurality of strip-like conductor members that are successively overlaid with an insulating material interposed between the conductor members.

With that feature, since the plural strip-like conductor members successively overlaid with the insulating material interposed between the conductor members are wound together, the plural sub-coils can be fabricated in one winding step, and hence manufacturing of the multi-phase transformer having that feature is facilitated.

According to still another aspect, in the multi-phase transformer described above, given that numerals being one or more integers and differing from each other are m and n, the plural conductor members are present in number (m+n), the number m of conductor members are connected in series when m is 2 or more, and the number n of conductor members are connected in series when n is 2 or more.

With that feature, since the plural sub-coils are constituted as two groups of sub-coils having a ratio of m:n, the multi-phase transformer having that feature can set a voltage ratio between the two groups of sub-coils to m:n. Thus, the multi-phase transformer having the voltage ratio of m:n is provided.

According to still another aspect, in the multi-phase transformer described above, a thickness of each of the number m of conductor members:a thickness of each of the number n of conductor members=n:m is satisfied.

With that feature, since (m)×(thickness of each of the number m of conductor members)=(n)×(thickness of each of the number n of conductor members) is satisfied, respective thicknesses of the sub-coils can be made equal to each other. As a result, the multi-phase transformer including the sub-coils of the same thickness is provided.

According to still another aspect, in any of the multi-phase transformers described above, the plural coils are disposed side by side in the same plane such that the axial directions of the plural coils are parallel to each other.

With that feature, the multi-phase transformer including the plural coils disposed side by side in the same plane is provided.

According to still another aspect, any of the multi-phase transformers described above further includes a heat transfer member filled in gaps that are generated between the plural coils and the magnetic members.

With that feature, since the above-mentioned gaps are filled with the heat transfer member, it is possible to transfer heat generated by the coils to the magnetic members through the heat transfer member, and to improve a heat dissipation effect in the multi-phase transformer having the above-described features.

According to still another aspect, in any of the multi-phase transformers described above, a thickness of the conductor member is not larger than ⅓ of a skin depth at a frequency of AC power that is supplied to the multi-phase transformer.

With that feature, since the thickness of the conductor member is not larger than ⅓ of the skin depth at the frequency of the AC power, the multi-phase transformer having that feature can reduce the eddy current loss. Additionally, given that the angular frequency of the AC power is co, the magnetic permeability of the conductor member is and the electrical conductivity of the conductor member is ρ, the skin depth δ is generally expressed by $\delta=(2/\omega\mu\rho)_{1/2}$.

Figure 14:
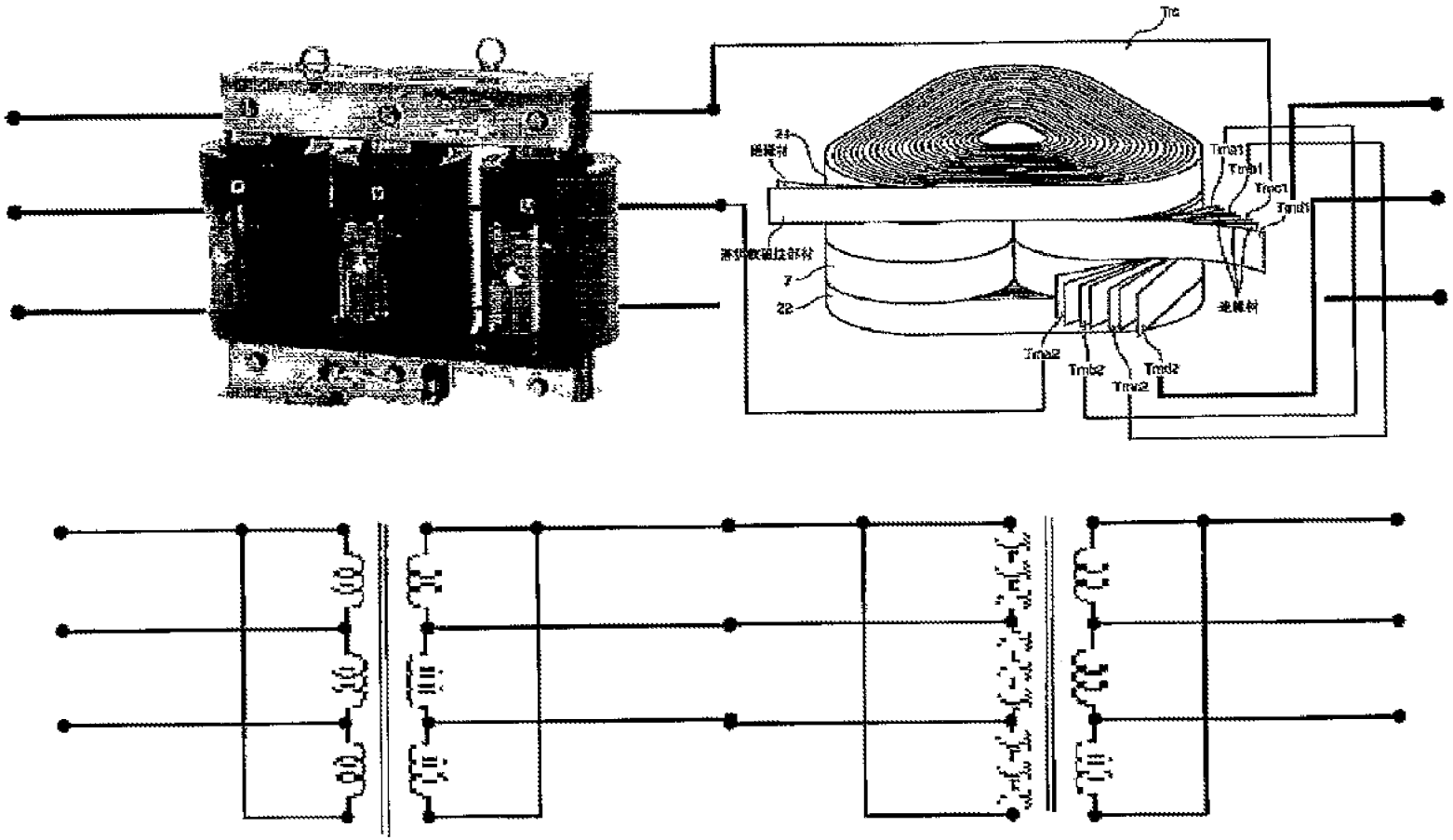
FIG. 14 is an illustration of a transformation system including a plurality of transformers connected in series.

A transformation system as shown in FIG. 14 according to still another aspect includes a plurality of transformers connected in series, wherein at least one of the plural transformers is the multi-phase transformer according to any one of the multi-phase transformers described above.

With that feature, the transformation system including the above-described multi-phase transformer is provided. Furthermore, with that feature, since the transformation system is constituted by multiple stages of transformers, it is possible to successively transform a voltage by the individual transformers, to reduce a voltage applied to one transformer, and to reduce a load per transformer.

This application is on the basis of Japanese Patent Application No. 2010-168543 filed Jul. 27, 2010 and Japanese Patent Application No. 2010-263745 filed Nov. 26, 2010, which are incorporated by reference herein in their entirety.

While the present invention has adequately and sufficiently been described above in connection with embodiments by referring to the drawings for the purpose of expressing the present invention, it is to be recognized that the foregoing embodiments can easily be modified and/or improved by those skilled in the art. Accordingly, it is to be construed that modified forms or improved forms carried out by those skilled in the art are involved within the scope of patent right defined in claims insofar as those forms do not depart from the scope of patent right defined in the claims.

INDUSTRIAL APPLICABILITY

The present invention can provide a multi-phase transformer having a structure that facilitates manufacturing of the transformer in comparison with the related art, and a transformation system including a plurality of such transformers connected in series.

The invention claimed is:

1. A multi-phase transformer comprising:

a plurality of coils; and a pair of magnetic members disposed at respective opposite ends of the plural coils in axial directions thereof, wherein each of the plural coils includes a plurality of sub-coils, and said plurality of sub-coils are formed by winding three of strip-like conductor members that are successively overlaid with an insulating material interposed between the conductor members such that a widthwise direction of each of the conductor members is aligned with an axial direction of the corresponding coil, and the first strip-like conductor member serves as a primary coil, and the second and third strip-like conductor members serve as a secondary coil, and the second and third strip-like conductor members are electrically connected to one another, and said plurality of sub-coils are disposed side by side such that respective axial directions of the sub-coils are parallel, and the pair of magnetic members functions as a part of a magnetic circuit for returning the magnetic flux generated by the primary coil and coupling the primary coil and the secondary coil to each other with mutual inductance, and said insulating material is disposed on an inner lateral surface of the conductor member, and the conductor member and the insulating material are wound together so as to be successively overlaid into a spiral shape.

2. The multi-phase transformer according to claim 1, wherein the magnetic members are formed using soft magnetic powder.

3. The multi-phase transformer according to claim 1, wherein the magnetic members are constituted by winding strip-like soft magnetic members such that widthwise directions of the soft magnetic members are aligned with the axial directions of the plural coils.

4. The multi-phase transformer according to claim 3, further comprising an insulating layer between turns of a wound soft magnetic member.

5. The multi-phase transformer according to claim 1, wherein a thickness of a soft magnetic member in a direction perpendicular to the axial direction is not larger than a skin depth at a frequency of AC power that is supplied to the multi-phase transformer.

6. The multi-phase transformer according to claim 1, wherein a soft magnetic member is coated over the conductor member.

7. The multi-phase transformer according to claim 1, wherein a soft magnetic member is press-bonded to the conductor member.

8. The multi-phase transformer according to claim 1, wherein the plural sub-coils are stacked in the axial direction of the corresponding coil.

9. The multi-phase transformer according to claim 1, wherein the plural sub-coils are stacked in a radial direction of the corresponding coil.

10. The multi-phase transformer according to claim 1, wherein the plural coils are disposed side by side in a same plane such that the axial directions of the plural coils are parallel to each other.

11. The multi-phase transformer according to claim 1, further comprising a heat transfer member filled in gaps that are generated between the plural coils and the magnetic members.

12. The multi-phase transformer according to claim 1, wherein a thickness of the conductor member is not larger than ⅓ of a skin depth at a frequency of AC power that is supplied to the multi-phase transformer.

13. The multi-phase transformer according to claim 1, wherein the second strip-like conductor member has an outer end at an outer axial portion of each of said plurality of sub-coils and the second strip-like conductor member has an inner end at an inner axial portion of each of said plurality of sub-coils, the third strip-like conductor member has an outer end at an outer axial portion of each of said plurality of sub-coils and the third strip-like conductor member has an inner end at an inner axial portion of each of said plurality of sub-coils, and the outer end of the second strip-like conductor member is electrically connected to the inner end of the third strip-like conductor member.

14. The multi-phase transformer according to claim 1, wherein each of the plurality of sub-coils do not have an annular core.

15. A transformation system including a plurality of transformers connected in series, wherein at least one of the plurality of transformers is a multi-phase transformer comprising:

a plurality of coils; and a pair of magnetic members disposed at respective opposite ends of the plural coils in axial directions thereof, wherein each of the plural coils includes a plurality of sub-coils, said plurality of sub-coils are formed by winding three of strip-like conductor members that are successively overlaid with an insulating material interposed between the conductor members such that a widthwise direction of each of the conductor members is aligned with an axial direction of the corresponding coil, and the first strip-like conductor member serves as a primary coil, and the second and third strip-like conductor members serve as a secondary coil, and the second and third strip-like conductor are electrically connected to each other, and said plurality of sub-coils are disposed side by side such that respective axial directions of the sub-coils are parallel, and the pair of magnetic members functions as a part of a magnetic circuit for returning the magnetic flux generated by the primary coil and coupling the primary coil and the secondary coil to each other with mutual inductance, said insulating material is disposed on an inner lateral surface of the conductor member, and the conductor member and the insulating material are wound together so as to be successively overlaid into a spiral shape.

16. The transformation system including a plurality of transformers connected in according to claim 15, wherein the second strip-like conductor member has an outer end at an outer axial portion of each of said plurality of sub-coils and the second strip-like conductor member has an inner end at an inner axial portion of each of said plurality of sub-coils, the third strip-like conductor member has an outer end at an outer axial portion of each of said plurality of sub-coils and the third strip-like conductor member has an inner end at an inner axial portion of each of said plurality of sub-coils, and the outer end of the second strip-like conductor member is electrically connected to the inner end of the third strip-like conductor member.

17. The transformation system including a plurality of transformers connected in according to claim 15, wherein each of the plurality of sub-coils do not have an annular core.

* * * * *